US006607693B1

(12) United States Patent
Saito et al.

(10) Patent No.: US 6,607,693 B1
(45) Date of Patent: Aug. 19, 2003

(54) TITANIUM ALLOY AND METHOD FOR PRODUCING THE SAME

(75) Inventors: Takashi Saito, Aichi (JP); Tadahiko Furuta, Aichi (JP); Kazuaki Nishino, Aichi (JP); Hiroyuki Takamiya, Aichi (JP)

(73) Assignee: Kabushiki Kaisha Toyota Chuo Kenkyusho, Aichi (JP)

( * ) Notice: Subject to any disclaimer, the term of this patent is extended or adjusted under 35 U.S.C. 154(b) by 0 days.

(21) Appl. No.: 09/762,703

(22) PCT Filed: Jun. 9, 2000

(86) PCT No.: PCT/JP00/03783

§ 371 (c)(1),
(2), (4) Date: Feb. 12, 2001

(87) PCT Pub. No.: WO00/77267

PCT Pub. Date: Dec. 21, 2000

(30) Foreign Application Priority Data

Jun. 11, 1999 (JP) ..... 11-165600

(51) Int. Cl.[7] ..... C22C 14/00

(52) U.S. Cl. ..... 420/417; 419/46; 75/228; 75/950; 148/421

(58) Field of Search ..... 420/417; 419/46; 75/950, 228; 148/421

(56) References Cited

U.S. PATENT DOCUMENTS 4,857,269 A * 8/1989 Wang et al. ..... 148/421
5,026,522 A 6/1991 Jackson et al.
5,545,227 A * 8/1996 Davidson et al. ..... 623/23.53
5,573,401 A * 11/1996 Davidson et al. ..... 433/173
5,871,595 A * 2/1999 Ahmed et al. ..... 148/421

FOREIGN PATENT DOCUMENTS

| | | |
|---|---|---|
| JP | 45-36653 | 11/1970 |
| JP | 52-147511 | 12/1977 |
| JP | 60-234934 | 11/1985 |
| JP | 61-157652 | 7/1986 |
| JP | 2-225642 | 9/1990 |
| JP | 03-229837 | 10/1991 |
| JP | 05-009630 | 1/1993 |
| JP | 05-111554 | 5/1993 |
| JP | 06-240390 | 8/1994 |
| JP | 2000-102602 | 4/2000 |

* cited by examiner

*Primary Examiner*—Roy King
*Assistant Examiner*—Andrew Wessman
(74) *Attorney, Agent, or Firm*—Oblon, Spivak, McClelland, Maier & Neustadt, P.C.

(57) ABSTRACT

A titanium alloy according to the present invention is characterized in that it comprises an element of Va group (the vanadium group) in an amount of 30–60% by weight and the balance of titanium substantially, exhibits an average Young's modulus of 75 GPa or less, and exhibits a tensile elastic limit strength of 700 MPa or more. This titanium alloy can be used in a variety of products, which are required to exhibit a low Young's modulus, a high elastic deformability and a high strength, in a variety of fields.

95 Claims, 1 Drawing Sheet

Conventional Titanium Alloy

Titanium Alloy of Present bvention

TITANIUM ALLOY AND METHOD FOR PRODUCING THE SAME

TECHNICAL FIELD

The present invention relates to a titanium alloy and a process for producing the same. Particularly, it relates to a titanium alloy, which can be utilized in a variety of products, and which exhibits a low Young's modulus, a high elastic deformability and a high strength, and a process for producing the same.

BACKGROUND ART

Since titanium alloys are good in terms of the specific strength, they are used in the fields of aviation, military affairs, space and deep-see exploration, and so on. In the field of automobile as well, titanium alloys have been used in valve retainers, connecting rods, etc., of racing engines. Further, since the titanium alloys are good in terms of the corrosion resistance, they are often used under the corrosive environment. For example, they are used as materials for chemical plants, oceanic constructions, and the like, furthermore, for the purpose of inhibiting the corrosion, etc., due to the anti-freezing agents, they are used as automobile front bumper lowers, rear bumper lowers, and the like. Moreover, by focusing on the lightness (specific strength) and the anti-allergic property (corrosion resistance), the titanium alloys are used in accessories, such as wristwatches, etc. Thus, the titanium alloys are used in various and diverse fields, and, as representative titanium alloys, there are Ti-5Al-2.5Sn (α alloy), Ti-6Al-4V (α–β alloy), Ti-13V-11Cr-3Al (β alloy), and so on.

By the way, the conventional titanium alloys have been often used while paying attention to the good specific strength and corrosion resistance, however, a titanium alloy (for example, the β alloy) has been often used recently while paying attention to the low Young's modulus. For example, the titanium alloys of the low Young's moduluses are used in organism compatible products (for instance, artificial bones, etc.), accessories (for example, frames of eyeglasses, etc.), sporting goods (for example, golf clubs, etc.), spring, and the like. When it is described by taking up concrete examples, in the case where the titanium alloy of the low Young's modulus is used in an artificial bone, the Young's modulus approaches a Young's modulus of a human bone (to a degree of about 30 GPa), and the artificial bone becomes good in terms of the organism compatibility in addition to the specific strength and corrosion resistance. Further, a frame of eyeglasses, which comprises the titanium alloy of the low Young's modulus, fits flexibly to a human body without giving an oppression feeling, and is good in terms of an impact absorbing property. Furthermore, when the titanium alloy of the low Young's modulus is used in a shaft or head of a golf club, it is said that a flexible shaft and a head exhibiting a low intrinsic frequency can be obtained so that a driving distance of a golf ball extends. Moreover, when a spring, which comprises a titanium alloy exhibiting a low Young's modulus, a high elastic deformability and a high strength, is obtained, a low spring constant can be achieved without increasing the number of turns, etc., and can be light-weighted and compacted.

Under these circumstances, the inventors of the present invention thought of developing a titanium alloy, which is intended to further expand the utilization in a variety of fields, and which exhibits a low Young's modulus, a high elastic deformability and a high strength going beyond the conventional levels. And, first of all, they searched for the prior art concerning the titanium alloys, which exhibit the low Young's modulus, and the following publications were discovered.

① Japanese Unexamined Patent Publication (KOKAI) No. 10-219,375

In this publication, a titanium alloy, which contains Nb and Ta in a summed amount of 20–60% by weight. Concretely, to begin with, raw materials are melted so that the composition is achieved, and a button ingot is cast. Next, a cold rolling, a solid solution treatment and an aging treatment are carried out onto the button ingot. Thus, a titanium alloy, which exhibits a low Young's modulus of 75 GPa or less, is obtained.

However, as can be understood from the examples disclosed in this publication, the tensile strength is lowered together with the low Young's modulus, and a titanium alloy, which exhibits a low Young's modulus, a high elastic deformability and a high strength, is not obtained. Moreover, on the cold working property, which is required to form the titanium alloy into products, there is no disclosure at all.

② Japanese Unexamined Patent Publication (KOKAI) No. 2-163,334

In this publication, there is disclosed "a titanium alloy comprising Nb: 10–40% by weight, V: 1–10% by weight, Al: 2–8% by weight, Fe, Cr and Mn: 1% by weight, respectively, Zr: 3% by weight or less, O: 0.05–0.3% by weight and the balance of Ti, and having a good cold working property".

Concretely, the titanium alloy having a good cold working property is obtained by carrying out a plasma melting, a vacuum arc melting, a hot forging and a solid solution treatment onto a raw material to be the composition.

However, on the Young's modulus and the tensile strength, nothing is set forth in the publication. Moreover, by the titanium alloy, $\ln(h_0/h)$: 1.35–1.45 is obtained as the maximum deformation ratio, at which no compression cracks occur, when this is converted into a cold working ratio later described, it is no more than about 50% at the highest.

③ Japanese Unexamined Patent Publication (KOKAI) No. 8-299,428

In this publication, a medical treatment appliance is disclosed which is formed of a titanium alloy comprising Nb of 20–40% by weight, Ta of 4.5–25% by weight, Zr of 2.5–13% by weight and the balance of Ti, and exhibiting a Young's modulus of 65 GPa or less.

④ Japanese Unexamined Patent Publication (KOKAI) No. 6-73,475, Japanese Unexamined Patent Publication (KOKAI) No. 6-233,811 and Published Japanese Translation Publication (KOHYO) No. 10-501,719 of PCT International Publications for Patent Application.

In these publications, titanium alloys of low Young's moduluses and high strengths are disclosed, however, concerning a titanium alloy exhibiting a Young's modulus of 75 GPa or less and exhibiting a tensile strength of 700 MPa or more, there is disclosed a Ti-13Nb-13Zr only. In addition, on the elastic limit strength and the elastic deformability, nothing is disclosed at all. Moreover, in the scope of the claims, there is set forth Nb: 35–50% by weight, there is not disclosed at all a concrete example corresponding to it.

⑤ Japanese Unexamined Patent Publication (KOKAI) No. 61-157,652

In this publication, there is disclosed "a metallic decorative article comprising Ti in an amount of 40–60% by weight and the balance of Nb substantially". Concretely, after arc melting a raw material having a composition of Ti-45Nb, it is subjected to a casting, a forging and rolling, and the resulting Nb alloy is subjected to a cold deep drawing, thereby obtaining a metallic decorative article. However, in the publication, nothing is set forth on a concrete cold working property at all.

Moreover, there are no descriptions on a Young's modulus, a tensile strength, etc., of the Nb alloy.

⑥ Japanese Patent Publication (KOKAI) No. 6-240,390

In this publication, there is disclosed "a material for a golf driver head comprising vanadium in an amount of from 10% by weight to less than 25% by weight, adjusting an oxygen content to 0.25% by weight or less, and the balance of titanium and inevitable impurities". However, a Young's modulus of the used alloy is no more than about 80–90 GPa.

⑦ Japanese Patent Publication (KOKAI) No. 5-111,554

In this publication, there is disclosed "a head of a golf club produced by a lost wax precision casting method with an Ni—Ti alloy having a super elasticity". In this publication, there is set forth that Nb, V, etc., can be added a little, however, there is no description on their concrete compositions at all, moreover, there are not disclosed at all on a Young's modulus, an elastic deformability and a tensile strength.

⑧ For reference, the Young's moduluses of conventional titanium alloys are remarked additionally, the α alloy exhibits about 115 GPa, the α+β alloy (for example, a Ti-6Al-4V alloy) exhibits about 110 GPa, and the β alloy (for example, Ti-15V-3Cr-3Al-3Sn), which is a[4]material subjected to a solid solution treatment, exhibits about 80 GPa, it exhibits about 110 GPa after it is subjected to an aging treatment. Moreover, when the inventors of the present invention examined and surveyed, the nickel-titanium alloy of the aforementioned publication ⑦ exhibited the Young's modulus of about 90 GPa.

DISCLOSURE OF THE INVENTION

The present invention has been done in view of these circumstances. Namely, as described above, the purpose is to provide a titanium alloy, which is intended to further expand the utilization in a variety of fields, and which exhibits a low Young's modulus, a high elastic deformability and a high strength going beyond the conventional levels.

Further, the purpose is to provide a titanium alloy, which exhibits a low Young's modulus and has a high elastic deformability as well as a high strength, and which exhibits a good cold working property so that it is readily formed into a variety of products.

Furthermore, the purpose is to provide a production process, which is suitable for producing such a titanium alloy.

The inventors of the present invention earnestly studied in order to solve this assignment, and carried out a variety of systematic experiments repeatedly, and, as a result, they completed to develop a titanium alloy, which comprises a predetermined amount of an element of Va group and titanium, and which exhibits a low Young's modulus as well as a high elastic deformability and a high strength.

(1) Namely, a titanium alloy according to the present invention is characterized in that the titanium alloy comprises an element of Va group (the vanadium group) in an amount of 30–60% by weight and the balance of titanium substantially, exhibits an average Young's modulus of 75 GPa or less, and exhibits a tensile elastic limit strength of 700 MPa or more.

By combining titanium and a proper amount of an element of Va group, a titanium alloy, which exhibits a low Young's modulus unconventionally and has a high elastic deformability as well as a high strength. And, the present titanium alloy can be utilized widely in a variety of products, and it is possible to intend the improvements of their functional properties and the enlargements of their designing freedom.

Here, the element of Va group is adjusted to 30–60% by weight, because a sufficient decrement of an average Young's modulus is not intended when it is less than 30% by weight, on the other hand, when it exceeds 60% by weight, a satisfactory elastic deformability and tensile strength are not obtained, and the density of the titanium alloy rises to decrease the specific strength. Moreover, when it exceeds 60% by weight, it is likely to cause not only the decrement of the strength but also the decrements of the toughness and ductility, because the material segregation is likely to take place to impair the homogeneity of the material.

And, the inventors of the present invention confirmed that this titanium alloy is provided with a good cold working property.

It is not clear still why the titanium alloy of that composition exhibits a low Young's modulus and a high elastic deformability as well as a high strength, and why it is good in terms of a cold working property. According to the surveys and researches, which were carried out so far by the inventors of the present invention, on their properties, it is possible to think as follows.

Namely, as a result of a survey, which was carried out by the inventors of the present invention, on a sample according to the titanium alloy of the present invention, it was proved that, even when this titanium alloy was subjected to a cold working process, the dislocation is hardly introduced, and the titanium alloy showed a structure whose (100) plane was oriented very heavily in a part of direction. Besides, in the dark field image employing the 111 diffraction point, which was observed by a TEM (Transmission Electron Microscope), it was observed that the contrast of the image moved together with the inclination of the sample. This indicates that the observed (111) plane is curved, and this was also confirmed by a lattice image direct observation of a high magnification. In addition, the curvature radius of this curve of the (111) plane was extremely small, and was 500–600 nm approximately. This means that the titanium alloy of the present invention relieves the influences of workings, not by the introduction of the dislocation, but by the curve of the crystal plane, and that it has a quality, which has not been known at all in conventional metallic materials.

Further, the dislocation was observed in a very extreme part, while the 111 diffraction point was heavily excited, but was hardly observed when the excitation of the 111 diffraction point disappeared. This indicates that the displacement components around the dislocation are biased remarkably in the <110> direction, and this suggests that the titanium alloy of the present invention exhibits a very heavy elastic anisotropy. The reason is not clear, but it is considered that this elastic anisotropy closely relates to the good cold working property, the appearance of the low Young's modulus, the high elastic deformability and the high strength, and the like, of the titanium alloy according to the present invention.

Note that the group Va element can be one kind or a plurality of kinds of vanadium, niobium and tantalum. All of these elements are β-phase stabilizing elements, however, it does not necessarily mean that the titanium alloy of the present invention is conventional β alloys.

Furthermore, heat treatments are not required necessarily, but it is possible to intend to further highly strengthen by heat treatments.

Moreover, the average Young's modulus can be preferable so that it is 70 GPa or less, 65 GPa or less, 60 GPa or less and 55 GPa or less in this order. The tensile elastic limit strength can be preferable so that it is 750 MPa or more, 800 MPa or more, 850 MPa or more and 900 MPa or more in this order.

Here, the "tensile elastic limit strength" is referred to a stress, at which a permanent strain reaches 0.2%, in a tensile test, in which a load is applied to and removed from a test piece gradually and repeatedly. It will be described later in more detail.

In addition, the "average Young's modulus" does not refer to the "average" of Young's modulus in the strict sense, but it means a Young's modulus, which represents the titanium alloy of the present invention. Concretely, in a stress (load)-strain (elongation) diagram, which is obtained by the aforementioned tensile test, a gradient (gradient of tangent line) of a curve at a stress position, which corresponds to ½ of the tensile elastic limit strength, is referred to as the average Young's modulus.

By the way, the "tensile strength" is a stress, which is obtained by dividing a load immediately before a final breakage of the test piece by a cross-sectional area of the parallel portion of the test piece before the test.

Note that the "high elastic deformability" in the present application means that the elongation of the test piece is large within the aforementioned tensile elastic limit strength. Further, the "low Young's modulus" in the present application means that the aforementioned average Young's modulus is smaller with respect to the conventional and general Young's modulus. Furthermore, the "high strength" in this application means that the aforementioned tensile elastic limit strength or the aforementioned tensile strength is large.

Note that the "titanium alloy" in the present invention includes a variety of forms, and that it means not only workpieces (for example, ingots, slabs, billets, sintered bodies, rolled products, forged products, wire rods, plates, rods, etc.) but also the titanium alloy members (for example, intermediately processed products, final products, parts of them, etc.), in which they are processed (hereinafter, the meanings are the same.).

(2) Alternatively, the titanium alloy of the present invention is characterized in that the titanium alloy is a sintered alloy comprising an element of Va group (the vanadium group) in an amount of 30–60% by weight and the balance of titanium substantially.

The present invention is based on a discovery that sintered alloys (sintered titanium alloys), which comprised titanium and proper amounts of the group Va elements, had such mechanical properties that they were of low Young's modulus and exhibited high elasticity deformabilities and high strengths.

And, the inventors of the present invention confirmed that this titanium alloy was provided with a good cold working property. The reason why the Va group element is adjusted to 30–60% by weight is as aforementioned.

It is not still clear why the titanium alloy of the composition exhibits low Young's modulus, high elasticity deformability and high strength, and why it is good in terms of the cold working property, however, at present, the reasons are believed as aforementioned.

(3) A process for producing a titanium alloy according to the present invention is characterized in that the process comprises the steps of: a mixing step of mixing at least two or more raw material powders containing titanium and an element of group Va in an amount of 30–60% by weight; a compacting step of compacting a mixture powder obtained by the mixing step to a green compact of a predetermined shape; and a sintering step of sintering the green compact obtained in the compacting step by heating.

The production process of the present invention (hereinafter, it is referred to as a "sintering process" wherever appropriate.) is suitable for producing the aforementioned titanium alloy.

As can be understood from the aforementioned patent publications, etc., the conventional titanium alloys are often produced by casting after melting a titanium raw material (for example, a sponge titanium) and an alloy raw material, and thereafter by rolling the resulting ingots (hereinafter, this process is referred to as a "melting process" wherever appropriate.).

However, since the titanium has a high melting point and is very active at elevated temperatures, it is difficult to carry out the melting itself, and there often arise cases where special apparatus are required to carry out the melting. Further, it is difficult to control the compositions during the melting, and it is necessary to carry out the multiple melting, and so on. Furthermore, a titanium alloy, such as the titanium alloy of the present invention, containing large amounts of the alloy components (particularly, the β-stabilizing elements), is less likely to avoid the macro segregations of the components, and a stable quality titanium alloy is difficult to obtain.

On the other hand, in accordance with the sintering process of the present invention, since it is not necessary to melt the raw materials, there are no disadvantages like the melting process, and it is possible to efficiently produce the titanium alloy according to the present invention.

To put it concretely, since the raw material powders are mixed uniformly by the mixing step, a homogeneous titanium alloy can be readily obtained. Further, since a green compact having a desired shape from the beginning can be compacted by the compacting step, the production steps can be significantly reduced. Note that the green compact can be compacted as workpiece shapes, such as plates, rods, etc., can be compacted as shapes of final products, or shapes of intermediate products before reaching them. And, in the sintering step, the green compact can be sintered at temperatures considerably lower than the melting points of titanium alloys, no special apparatuses like those of the melting process are required, and, moreover, it is possible to carry out an economical and efficient production.

Note that the production process of the present invention uses two or more raw material powders in view of the mixing step, and is based on the so-called blended elemental (mixing) method.

(4) A process for producing a titanium alloy according to the present invention is characterized in that the process comprises the steps of: a packing step of packing a raw material powder containing titanium and at least an element of group Va in an amount of 30–60% by weight into a container of a predetermined shape; and a sintering step of sintering the raw material powder in the container by using a hot isostatic pressing method (HIP method) after the packing step.

In accordance with the production process of the present invention, the aforementioned mixing step and/or the compacting step are not required necessarily. Moreover, in accordance with the production process of the present invention, the so-called pre-alloyed powder metallurgy method can be carried out. Accordingly, the kinds of usable raw material powders are broadened, not only mixture powders, in which two or more of pure metallic powders and/or pre-alloyed powders are mixed, but also pre-alloyed powders, which have the aforementioned or later described compositions of the titanium alloys of the present invention, can be used. And, by using the HIP method, dense sintered titanium alloys can be obtained, and, even if the product shape is complicated, the net shape can be carried out.

Note that the composition ranges of the aforementioned respective elements are shown in a form of "x-y % by weight", unless otherwise specified, it means to include the lower limit value (x % by weight) and the upper limit value (y % by weight).

BEST MODE FOR CARRYING OUT THE INVENTION

Titanium Alloy (1) Average Young's Modulus and Tensile Elastic Limit Strength An average Young's modulus and a tensile elastic limit strength, which are concerned with a titanium alloy of the present invention, will be hereinafter described in detail by using FIGS. 1A and 1B. FIG. 1A is a drawing, which schematically illustrates a stress-strain diagram of the titanium alloy according to the present invention, and FIG. 1B is a drawing, which schematically illustrates a stress-strain diagram of a conventional titanium alloy (Ti-6Al-4V alloy).

Figure 1B:
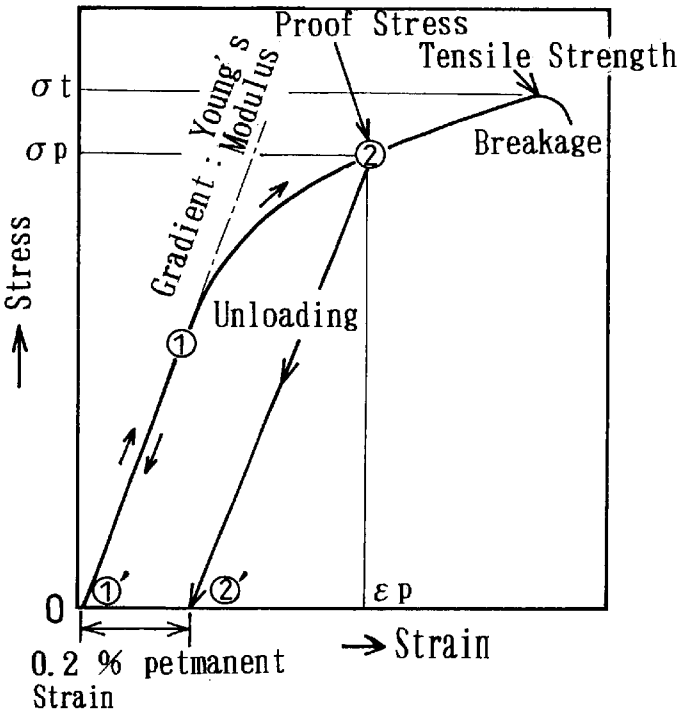
FIG. 1B is a drawing, which schematically illustrates a stress-strain diagram of a conventional titanium alloy.
Figure 1A:
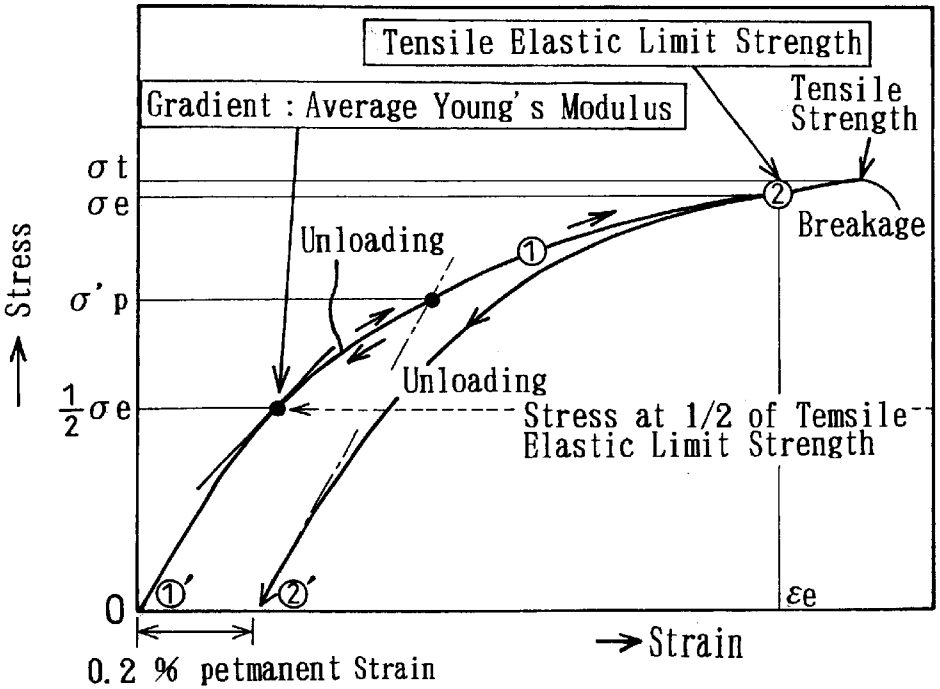
FIG. 1A is a drawing, which schematically illustrates a stress-strain diagram of a titanium alloy according to the present invention.

① As illustrated in FIG. 1B, in the conventional metallic material, first of all, the elongation increases linearly in proportion to the increment of the tensile stress (between ①'–①). And, the Young's modulus of the conventional metallic material is determined by the gradient of the straight line. In other words, the Young's modulus is a value, which is determined by dividing a tensile stress (nominal stress) with a strain (nominal strain), which is in a proportional relationship thereto.

In the straight line range (between ①'–①), in which the stress and the elongation (strain) are in a proportional relationship, the deformation is elastic, for example, when the stress is unloaded, the elongation, being the deformation of a test piece, returns to 0. However, when a tensile stress is further applied beyond the straight line range, the conventional metallic material starts deforming plastically, even when the stress is unloaded, the elongation of the test piece does not return to 0, and there arises a permanent elongation.

Ordinarily, a stress $\sigma p$, at which a permanent strain becomes 0.2%, is referred to as a 0.2% proof stress (JIS Z 2241). This 0.2% proof stress is also a stress at the intersection (position ②) between a straight line (②'–②), which is obtained by parallelly moving the straight line (①'–①: the tangential line of the rising portion) in the elastic deformation range by a 0.2% strain, and the stress-strain curve on the stress-strain diagram.

In the case of conventional metallic materials, it is ordinarily considered the 0.2% proof stress ≈the tensile elastic limit strength based on the empirical rule "when the stress exceeds about 0.2%, it becomes the permanent stress". Conversely, within the 0.2% proof stress, it is believed that the relationship between the stress and the strain is generally linear or elastic.

② However, as can be seen from the stress-strain diagram of FIG. 1A, such a conventional concept cannot be applied to the titanium alloy of the present invention. The reasons are not clear, however, in the case of the titanium alloy of the present invention, the stress-strain diagram does not become linear in the elastic deformation range, but it becomes an upwardly convexed curve (①'–②), when the stress is unloaded, the strain returns to 0 along the same curve ①–①', or there arises a permanent strain along ②–②'.

Thus, in the titanium alloy of the present invention, the stress and the strain is not in the linear relationship even in the elastic deformation range (①–①'), when the stress increases, the strain increases sharply. Moreover, it is the same in the case where the stress is unloaded, the stress and the strain are not in the linear relationship, when the stress decreases, the strain decreases sharply. These characteristics are believed to arise as the high elastic deformability of the titanium alloy of the present invention.

By the way, in the case of the titanium alloy of the present invention, it is appreciated from FIG. 1A as well that the more the gradient of the tangential line in the stress-strain diagram decreases, the more the stress increases. Thus, in the elastic deformation range, since the stress and the strain do not change linearly, it is not appropriate to define the Young's modulus of the present invention by the conventional method.

Moreover, in the case of the titanium alloy of the present invention, since the stress and the strain do not change linearly, it is not appropriate either to evaluate 0.2% proof stress ($\sigma p'$)≈tensile elastic limit strength by the same method as the conventional method. That is, the 0.2% proof stress, which is determined by the conventional method, has become a remarkably smaller value than the inherent tensile elastic limit strength, and it is not even possible to consider 0.2% proof stress ≈tensile elastic limit strength.

Therefore, by turning back to the original definition, it is decided to determine the tensile elastic limit strength ($\sigma e$) of the titanium alloy of the present invention as aforementioned (position ② in FIG. 1A), and is further decided to introduce the aforementioned average Young's modulus herein as the Young's modulus of the titanium alloy of the present invention.

Note that, in FIG. 1A and FIG. 1B, $\sigma t$ is the tensile strength, $\sigma e$ is the strain at the tensile elastic limit strength ($\sigma e$) of the titanium alloy of the present invention, and $\epsilon p$ is the strain at the 0.2% proof stress ($\sigma p$) of the conventional metallic material.

(2) Composition

① The titanium alloy of the present invention, when the entirety is taken as 100% by weight, can preferably contain one or more elements selected from the metallic element group consisting of zirconium (Zr), hafnium (Hf) and scandium (Sc) in a summed amount of 20% by weight or more.

Zirconium and hafnium are effective to lower the Young's elasticity and to heighten the strength. Moreover, since these elements are the same group (IVa) element as the titanium, and since they are complete solid solution type neutral elements, they do not disturb the lowering of the Young's modulus by the Va group element.

Further, in the case where the scandium solves into the titanium, it singularly decreases the bond energy between the titanium atoms together with the group Va element, and is an effective element to further lower the Young's modulus (Reference Material: Proc. 9th World Conf. on Titanium, (1999), to be published).

When those elements exceed 20% in total, it is not preferable because it causes the decrement of the strength and toughness by the material segregation and the increment of the cost.

In order to balance among the Young's modulus, the strength, the toughness, etc., those elements can preferably contain 1% by weight or more, further preferably 5–15% by weight, in total.

Furthermore, since these elements are common to the Va group element in many aspects in view of the operations, they can be replaced by the Va group element within a predetermined range.

That is, it is preferred that the titanium alloy of the present invention comprises one or more elements selected from the metallic element group consisting of zirconium (Zr), hafnium (Hf) and scandium (Sc) in a summed amount of 20% by weight or less, an element of Va group (the vanadium group) in a summed amount of 30–60% by weight together with the one or more elements of the metallic element group and the balance of titanium substantially, exhibits an average Young's modulus of 75 GPa or less, and exhibits a tensile elastic limit strength of 700 MPa or more.

Alternatively, it is preferred that the titanium alloy of the present invention is a sintered alloy, which comprises one or more elements selected from the metallic element group consisting of zirconium (Zr), hafnium (Hf) and scandium (Sc) in a summed amount of 20% by weight or less, an element of Va group (the vanadium group) in a summed amount of 30–60% by weight together with the one or more elements of the metallic element group, and the balance of titanium substantially.

Zirconium, etc., are adjusted to a summed amount of 20% by weight or less, as aforementioned. Moreover, similarly, those elements can preferably be in a summed amount of 1% by weight or less, and further preferably 5–15% by weight.

② It is preferred that the titanium alloy of the present invention contains one or more elements selected from the metallic element group consisting of chromium (Cr), molybdenum (Mo), manganese (Mn), iron (Fe), cobalt (Co) and nickel (Ni). More concretely, when the entirety is taken as 100% by weight, it is preferred that the aforementioned chromium and the aforementioned molybdenum are 20% by weight or less, respectively, and the aforementioned manganese, the aforementioned iron, the aforementioned cobalt and the aforementioned nickel are 10% by weight or less, respectively.

The chromium and the molybdenum are effective elements in improving the strength and hot forgeability of the titanium alloy. When the hot forgeability is improved, the improvements of the productivity and material yield of the titanium alloy can be intended. Here, when the chromium or the molybdenum exceeds 20% by weight, the material segregation is likely to take place so that it is difficult to obtain a homogeneous material. When those elements are 1% by weight or more, it is preferable to intend the improvements of the strength, etc., by the solid solution strengthening, and is further preferable to be 3–15% by weight.

The manganese, the iron, the cobalt and the nickel, similarly to the molybdenum, etc., are effective elements in improving the strength and hot forgeability of the titanium alloy. Accordingly, instead of the molybdenum, the chromium, etc., or in addition to the molybdenum, the chromium, etc., those elements can be contained. However, when those of the elements exceed 10% by weight, it is not preferable because they form intermetallic compounds between them and the titanium so that the ductility decreases. When those elements are 1% by weight or more, it is preferable to intend the improvements of the strength, etc., by the solid solution strengthening, and is further preferable to be 2–7% by weight.

③ In the case where the titanium alloy of the present invention is the sintered alloy, it is appropriate that tin is added in addition to the aforementioned metallic element group.

Namely, it is more appropriate that the sintered titanium alloy of the present invention contains one or more elements selected from the metallic element group consisting of chromium (Cr), molybdenum (Mo), manganese (Mn), iron (Fe), cobalt (Co), nickel (Ni) and tin (Sn). Concretely, when the entirety is taken as 100% by weight, it is much more appropriate that the aforementioned chromium and the aforementioned molybdenum are 20% by weight or less, respectively, and the aforementioned manganese, the aforementioned iron, the aforementioned cobalt, the aforementioned nickel and the aforementioned tin are 10% by weight or less.

The tin is an α-stabilizing element, and is an effective element in improving the strength of the titanium alloy. Accordingly, the tin of 10% by weight or less can be contained together with the elements, such as the molybdenum, etc. When the tin exceeds 10% by weight, the ductility of the titanium alloy decreases so as to cause the decrement of the productivity. When the tin is 1% by weight or more, further, when it is 2–8% by weight, it is further preferable to intend in highly strengthening along with lowering the Young's modulus. Note that, on the elements, such as the molybdenum, etc., they are the same as aforementioned.

④ It is appropriate that the titanium alloy of the present invention contains aluminum. Concretely, it is further preferred that, when the entirety is taken as 100% by weight, the aforementioned aluminum is 0.3–5% by weight.

The aluminum is an effective element in improving the strength of the titanium alloy. Accordingly, the aluminum of 0.3–5% by weight can be contained instead of the molybdenum, the iron, etc., or in addition to those elements. When the aluminum is less than 0.3% by weight, the solid solution strengthening operation is insufficient so that the sufficient improvement of the strength cannot be intended. Moreover, when it exceeds 5% by weight, it decreases the ductility of the titanium alloy. When the aluminum is 0.5–3% by weight, it is further preferable in view of intending the stable improvement of the strength.

Note that, when the aluminum is added together with the tin, it is further preferable because the strength can be improved without decreasing the toughness of the titanium alloy.

⑤ It is appropriate that, when the entirety is taken as 100% by weight, the titanium of the present invention contains oxygen (O) of 0.08–0.6% by weight.

Further, when the entirety is taken as 100% by weight, the containment of carbon (C) of 0.05–1.0% by weight is appropriate.

Furthermore, when the entirety is taken as 100% by weight, the containment of nitrogen (N) of 0.05–0.8% by weight is appropriate.

To summarize, it is appropriate, when the entirety is taken as 100% by weight, that one or more elements selected from the element group consisting oxygen (O) of 0.08–0.6% by weight, carbon (C) of 0.05–1.0% by weight and nitrogen (N) of 0.05–0.8% by weight are contained.

The oxygen, the carbon and the nitrogen are all interstitial type solid solution strengthening elements, and are effective elements in stabilizing the a phase of the titanium alloy so as to improve the strength.

When the oxygen is less than 0.08% by weight, and when the carbon or the nitrogen is less than 0.05% by weight, the improvement of the strength of the titanium alloy is not satisfactory. Moreover, when the oxygen exceeds 0.6% by weight, when the carbon exceeds 1.0% by weight and when the nitrogen exceeds 0.8% by weight, it is not preferable to cause the embrittlement of the titanium alloy. When the oxygen is 0.1% by weight or more, further, 0.15–0.45% by weight, it is further preferable in terms of the balance between the strength and ductility of the titanium alloy. Similarly, when the carbon is 0.1–0.8% by weight, and when the nitrogen is 0.1–0.6% by weight, it is further preferable in terms of the balance between the strength and ductility.

⑥ It is appropriate that, when the entirety is taken as 100% by weight, the titanium of the present invention contains boron (B) of 0.01–1.0% by weight.

The boron is an effective element in improving the mechanical properties and hot workability of the titanium alloy. The boron hardly solves into the titanium alloy, and substantially all the amount thereof is precipitated as titanium compound particles (TiB particles, etc.). It is because these precipitated particles remarkably inhibit the crystalline granular growth of the titanium alloy so that the structure of the titanium alloy is maintained finely.

When the boron is less than 0.01% by weight, the effect is not sufficient, when it exceeds 1.0% by weight, the rising of the whole Young's modulus of the titanium alloy and the decreasing of the cold workability are taken place by increasing the precipitated particles of high rigidity.

Note that, in the case where the boron of 0.01% by weight is added, it is 0.055% by volume by the conversion as the TiB particles, while in the case where the boron of 1% by weight is added, it is 5.5% by volume by the conversion as the TiB particles. Accordingly, to put it differently, the titanium alloy of the present invention is preferred that the titanium boride particles fall in a range of from 0.055% by volume to 5.5% by volume.

By the way, the aforementioned respective component elements can be combined optionally within the predetermined ranges. Concretely, the titanium alloy of the present invention can be made by suitably and selectively combining the aforementioned Zr, Hf, Sc, Cr, Mo, Mn, Fe, Co, Ni, Sn, Al, O, C, N and B within the aforementioned ranges. However, this does not exclude to further compound other elements within ranges, which do not deviate from the gist of the titanium alloy of the present invention.

(2) Cold Working Structure

The cold working structure is a structure which is obtained by cold working the titanium alloy. The inventors of the present invention discovered that the aforementioned titanium alloy was very good in terms of the cold workability, and that the titanium alloy, which was subjected to a cold working, exhibited a remarkably low Young's modulus, a high elastic deformability and a high strength.

The "cold working" means a temperature sufficiently lower than the recrystallization temperature (the lowest temperature causing the recrystallization) of the titanium alloy. The recrystallization temperature depends on the compositions, but it is generally about 600° C., and, usually, the titanium alloy of the present invention can preferably be cold worked in the range of from an ordinary temperature to 300° C.

Further, the cold working structure of X % or more is referred to as a cold working structure, which is made when a cold working ratio defined by the following equation is X % or more.

$$\text{Cold Working Ratio "}X\text{"}=(S_0-S)/S_0\times 100(\%)$$

($S_0$: Cross Sectional Area before Cold Working, S: Cross Sectional Area after Cold Working)

By such a cold working, a strain is given in the titanium alloy. It is believed that this strain brings about a micro constructional change in the compositional structure at an atomic level, and that it contributes to reducing the Young's modulus of the present invention.

Furthermore, it is believed that the accumulation of the elastic strain, which is accompanied by the micro constructional change at an atomic level resulting from the cold working, contributes to improving the strength of the titanium alloy.

Concretely, it is appropriate that it has the cold working structure of 10% or more, exhibits the average Young's modulus of 70 GPa or less, and exhibits the tensile elastic limit strength of 750 MPa.

By giving the cold working, the lowering of the Young's modulus, heightening of the elastic deformability and heightening of the strength of the titanium alloy can be further developed.

Moreover, it is appropriate that the titanium alloy of the present invention has the aforementioned cold working structure of 50% or more, exhibits the Young's modulus of 65 GPa or less, and exhibits the tensile elastic limit strength of 800 MPa or more. In addition, it is further appropriate that the titanium alloy of the present invention has the aforementioned cold working structure of 70% or more, exhibits the Young's modulus of 60 GPa or less, and exhibits the tensile elastic limit strength of 850 MPa or more. Still, it is remarkably appropriate that the titanium alloy of the present invention has the aforementioned cold working structure of 90% or more, exhibits the Young's modulus of 55 GPa or less, and exhibits the tensile elastic limit strength of 900 MPa or more.

The titanium alloy of the present invention can make the cold working ratio 99% or more, the details are not clear yet, but it is clearly different from the conventional titanium alloys. By comparing with a conventional titanium alloy (for example, Ti-22V-4Al: so-called DAT51, etc. ), which is good in terms of the cold working property, the cold working ratio of the titanium alloy according to the present invention is a quite amazing value.

Thus, since the titanium alloy of the present invention is extremely good in terms of the cold working property, and since its material properties and mechanical properties tend to be further improved, it is the most suitable material for a variety of cold-worked and formed products, which require to exhibit not only a low Young's modulus but also a high elastic deformability and a high strength.

(3) Sintered Alloy (Sintered Titanium Alloy)

A sintered alloy is an alloy, which is obtained by sintering a raw material powder. In the case where the titanium alloy of the present invention is a sintered alloy, it effects a low Young's modulus, a high elastic deformability, a high strength and a good cold workability.

For instance, the sintered titanium alloy can exhibit the average Young's modulus of 75 GPa or less and the tensile elastic limit strength of 700 MPa or more.

Further, the titanium alloy of the present invention can adjust the Young's modulus, the strength, the density and so on by adjusting a pore amount in its structure. For example, it is appropriate that the sintered alloy contains pores of 30% by volume or less. By making the pores 30% by volume or less, even when it has the same alloy composition, it is accordingly possible to sharply reduce the average Young's modulus.

While, when the sintered alloy is a structure, in which the pores are densified to 5% by volume or less by hot working, it is appropriate because new merits are given thereto.

Namely, when the sintered alloy is densified by hot working, the titanium alloy can have a good cold workability in addition to the low Young's modulus, the high elastic deformability and the high strength. And, it is more appropriate that the pores are decreased to 1% by volume or less.

Note that, the hot working means plastic deformation carried out at recrystallization temperatures or more, for instance, there are hot forging, hot rolling, hot swaging, HIP, etc.

Furthermore, the pores mean voids, which reside in sintered alloys, and are evaluated by a relative density. The relative density is expressed by a percentage value $(\rho/\rho_0)\times 100$ (%) in which a density $\rho$ of a sintered substance is divided by a true density $\rho$ (in the case where the residual pores are 0%), the volume % of the pores is expressed by the following equation.

$$\text{volume \% of Pores}=\{1-(\rho/\rho_0)\}\times 100(\%)$$

For example, in the case where a metallic powder is subjected to a CIP (Cold Isostatic Pressing), it is possible to readily adjust the volumetric amount of the pores by adjusting the hydrostatic pressure (for instance, 2–4 ton/cm$^2$).

The size of the pores are not limited in particular, however, for example, when the average diameter is 50 $\mu$m or less, the uniformity of the sintered alloy is maintained, the decrement of the strength is suppressed, and the titanium alloy has a proper ductility. Here, the average diameter means the average diameter of circles, which is calculated by substituting the circles, having equivalent cross sectional areas, for the pores, which are measured by a two-dimensional image processing.

The Production Process of the Titanium Alloy

(1) Raw Material Powder

The raw material powder, which is needed in the case of the sintering method, contains at least titanium and a Va group element. However, they can take a variety of forms. For example, the raw material powder can further contain Zr, Hf, Sc, Cr, Mo, Mn, Fe, Co, Ni, Sn, Al, O, C, N or B.

Concretely, for instance, it is appropriate that, when the entirety is taken as 100% by weight, the raw material powder contains one or more elements, selected from the metallic element group consisting of zirconium (Zr), hafnium (Hf) and scandium (Sc), in a summed amount of 20% by weight or less.

And, it is appropriate that a production process of the present invention comprises the steps of: a mixing step of mixing at least two or more raw material powders containing one or more elements selected from the metallic element group consisting of zirconium (Zr), hafnium (Hf) and scandium (Sc) in a summed amount of 20% by weight or less and an element of Va group (the vanadium group) in a summed amount of 30–60% by weight together with the one or more elements of the metallic element group; a compacting step of compacting a mixture powder obtained by the mixing step to a green compact of a predetermined shape; and a sintering step of sintering the green compact obtained in the compacting step by heating.

Alternatively, it is appropriate that a production process of the present invention comprises the steps of: a packing step of packing a raw material powder containing at least titanium, one or more elements selected from the metallic element group consisting of zirconium (Zr), hafnium (Hf) and scandium (Sc) in a summed amount of 20% by weight or less and an element of Va group (the vanadium group) in a summed amount of 30–60% by weight together with the one or more elements of the metallic element group into a container of a predetermined shape; and a sintering step of sintering the raw material powder in the container by using a hot isostatic pressing method (HIP method) after the packing step.

It is appropriate that the raw material powder further contains at least one or more element selected from the group consisting of chromium, manganese, cobalt, nickel, molybdenum, iron, tin, aluminum, oxygen, carbon, nitrogen and boron.

In the case where the production process of the present invention is accompanied by the mixing step, it is appropriate that the raw material comprises two or more of pure metallic element powders and/or alloy powders.

As a concrete usable powder, for example, a sponge powder, a hydride-dehydride titanium powder, a titanium hydride powder, an atomized powder, etc, can be used. The particle configuration and particle diameter (particle diameter distribution) of the powder are not limited in particular, a commercially available powder can be used as it is. However, the usable powder, in view of the cost and denseness of a sintered body, it is preferred that the average particle diameter is 100 $\mu$m or less. Moreover, when the particle diameter of the powder is 45 $\mu$m (#325) or less, it is likely to obtain a much denser sintered body.

In the case where the production process of the present invention employs the HIP method, it is appropriate that the raw material powder comprises an alloy powder, which contains titanium and at least a Va group element. This alloy powder is a powder, which is provided with the composition of the titanium alloy according to the present invention, and it is produced, for example, by a gas atomizing method, an REP method (Rotary Electrode method), a PREP method (Plasma Rotary Electrode method), or a method, in which an ingot, produced by the melting process, is hydrogenated and is thereafter pulverized, moreover, an MA method (Mechanical Alloying Method), and so forth.

(2) Mixing Step

The mixing step is a step, in which the raw material powder is mixed. In mixing them, a V-shaped mixer, a ball mill and a vibration mill, a high energy ball mill (for instance, an attritor), etc., can be used.

(3) Compacting Step

The compacting step is a step, in which a mixture powder obtained in the mixing step is formed into a green compact of a predetermined shape. The shape of the green compact can be final shapes of products, or can be a billet shape, etc., in the case where a processing is further carried out after the sintering step.

As the compacting step, for example, the die forming, the CIP (Cold Isostatic Pressing), the RIP forming (Rubber Isostatic Press Forming), and so on, can be used.

(4) Packing Step

The packing step is a step, in which the aforementioned raw material powder containing at least titanium and the Va group element is packed into a container of a predetermined shape, and it is necessary to use the hot isostatic pressing method (HIP method). The inner shape of the container, into which the raw material powder is packed, corresponds to a desired product shape. Further, the container can be made, for example, from a metal, from a ceramic, or from glass. Furthermore, after vacuum degassing, the raw material powder can be packed into and sealed in the container.

(5) Sintering Step

The sintering step is a step, in which the green compact, obtained in the aforementioned compacting step, is heated to sinter, thereby obtaining a sintered body, or the powder in the aforementioned container is pressurized and solidified by using the hot isostatic pressing method (HIP) after the aforementioned packing step.

In the case where the green compact is sintered, it is preferred that it is carried out in an atmosphere of a vacuum or inert gas. Further, it is preferred that the sintering temperature is carried out at the melting point of the alloy or less and in a temperature range where the component elements are diffused sufficiently, for instance, the temperature range is 1,200° C.–1,400° C. Furthermore, it is preferred that the sintering time is 2–16 hours. Accordingly, in view of intending to densify the titanium alloy and to make the productivity efficient, it is suitable that the sintering step is carried out under the conditions at 1,200° C.–1,400° C. and for 2–16 hours.

In the case where it is done by the HIP method, it is preferred that it is carried out in a temperature range where the diffusion is easy, the powder exhibits a small deformation resistance, and it is less likely to react with the aforementioned container. For instance, the temperature range is 900° C.–1,300° C. Furthermore, it is preferred that the forming pressure is a pressure, at which the packed powder can adequately carry out the creep deformation, for example, the pressure range is 50–200 MPa (500–2,000 atm). It is preferred that processing time of the HIP is a time, within which the powder can sufficiently carry out the creep deformation to densify and the alloy components can diffuse among the powders, for instance, the time is 1 hour–10 hours.

(6) Processing Step

① By carrying out the hot working, it is possible to densify the structure by reducing the pores, etc., in the sintered alloy.

Accordingly, it is appropriate that the production process of the present invention further has a hot working step, in which the structure of the sintered body is densified by hot working the sintered body, which is obtained after the aforementioned sintering step. This hot working can be carried out to form rough shapes of products.

② Since the titanium alloy obtained by the production process of the present invention is good in terms of the cold workability, a variety of products can be produced by cold working the obtained sintered body.

Hence, it is appropriate that the production process of the present invention further has a cold working step, in which the sintered substance obtained after the sintering step is formed as workpieces or products by cold working. And, it is suitable that, after carrying out a rough processing by the aforementioned hot working, a finish processing can be carried out by cold working.

The Usage of the Titanium Alloy

Since the titanium alloy of the present invention exhibits the low Young's modulus, the high elastic deformability and the high strength, it can be used widely to products, which match the characteristics. Further, since it is also provided with the good cold workability, when the titanium alloy is used to cold-worked products, the processing crack, etc., can be reduced sharply so that the material yield is improved. Furthermore, even products, which are made from the conventional titanium alloys, and which require cutting processes configurationally, can be formed of the titanium alloy of the present invention by cold forging, and so on, and it is very effective in order to mass-produce titanium products and to reduce the costs For instance, the titanium alloy of the present invention is applicable to industrial machines, automobiles, motorbikes, bicycles, household electric appliances, aero and space apparatuses, ships, accessories, sports and leisure articles, products relating to living bodies, medical equipment parts, toys, and the like.

With reference to a (coiled) spring of an automobile, the titanium alloy of the present invention exhibits a Young's modulus of from ⅓ to ⅕ with respect to a conventional spring steel, in addition, since the elastic deformability is 5 times or more, the number of turns can be decreased from ⅓ to ⅕. Moreover, since the present titanium alloy has a specific weight of 70% with respect to those of steels used usually as a spring, a considerable light-weighting can be realized.

Further, with reference to a frame of eyeglasses as accessories, since the titanium alloy of the present invention exhibits a lower Young's modulus than those of conventional titanium alloys, it is likely to bend at the temples, etc., so that it fits well with a face, and, further, it is good in terms of the impact absorbing property and the recovering property of the configuration. Furthermore, since it exhibits a high strength and is good in terms of the cold workability, it is easy to form it into from a fine line material to a frame of eyeglasses, and the like, and can be intended to improve the material yield. Moreover, in accordance with the frame of eyeglasses made from the fine line material, the fitness, light-weighting, wearing property, and so on, of the eyeglasses are furthermore improved.

Still, it is described with reference to a golf club as sports and leisure articles, for instance, in the case where a shaft of a golf club comprises the titanium alloy of the present invention, the shaft is likely to flex, an elastic energy to be transmitted to a golf ball increases, and it can be expected to improve the driving distance of the golf ball. Still further, in the case where a head of a golf club, especially, a face part comprises the titanium alloy of the present invention, the intrinsic frequency of the head can be remarkably reduced by the low Young's modulus and the thinning resulting from the high strength, in accordance with the golf club provided with the head, it is expected to greatly extend a driving distance of the golf ball. Note that the theories regarding golf clubs are disclosed, for example, in Japanese Examined Patent Publication (KOKOKU) No. 7-98,077, International Laid-Open Publication No. WO98/46,312, etc.

In addition, in accordance with the titanium alloy of the present invention, due to the excellent characteristics, it is possible to improve the hitting feeling, etc., of golf clubs, and the designing freedom of golf clubs can be enlarged remarkably.

Further, in the field of medical treatments, the titanium alloy of the present invention can be used in artificial bones, artificial joints, artificial transplantation tissues, fasteners for bones, and the like, which are disposed in a living body, and to functional members (catheters, forcepses, valves, etc.), and so on, of medical instruments. For example, in the case where an artificial bone comprises the titanium alloy of the present invention, the artificial bone has a low young's modulus, which is approximate to those of human bones, the balance is intended to keep up with human bones so that it is good in terms of the living body compatibility, and, in addition, it has a sufficiently high strength as bones.

Furthermore, the titanium alloy of the present invention is suitable for damping members. This is because, as it is understood from the relational equation, $E=\rho V2$ (E: Young's modulus, ρ: Material Density, V: Acoustic Velocity Transmitted in the Material), that the acoustic velocity, which is transmitted in the material, can be reduced by decreasing the Young's modulus.

In addition, the present invention can be used in a variety of respective products in a variety of fields, for example, raw materials (wire, rods, square bars, plates, foils, fibers, fabrics, etc.), portable articles (clocks (wrist watches), barretters (hair accessories), necklaces, bracelets, earrings, pierces, rings, tiepins, brooches, cuff links, belts with buckles, lighters, nibs of fountain pens, clips for fountain pens, key rings, keys, ballpoint pens, mechanical pencils, etc.), portable information terminals (cellular phones, portable recorders, cases, etc., of mobile personal computers, etc., and the like), springs for engine valves, suspension springs, bumpers, gaskets, diaphragms, bellows, hoses, hose bands, tweezers, fishing rods, fishhooks, sewing needles, sewing-machine needles, syringe needles, spikes, metallic brushes, chairs, sofas, beds, clutches, bats, a variety of wires, a variety of binders, clips for papers, etc., cushioning materials, a variety of metallic sheets, expanders, trampolines, a variety of physical fitness exercise apparatuses, wheelchairs, nursing apparatuses, rehabilitation apparatuses, brassieres, corsets, camera bodies, shutter component parts, blackout curtains, curtains, blinds, balloons, airships, tents, a variety of membranes, helmets, fishing nets, tea strainers, umbrellas, firemen's garments, bullet-proof vest, a variety of containers, such as fuel tanks, etc., inner linings of tires, reinforcement members of tires, chassis of bicycles, bolts, rulers, a variety of torsion bars, spiral springs, power transmission belts (hoops, etc., of CVT), and so on.

And, the titanium alloy according to the present invention and the products can be produced by a variety of production processes, such as casting, forging, super plastic forming, hot working, cold working, sintering, and the like.

EXAMPLES

Hereinafter, a variety of concrete examples whose compositions, cold working ratios, etc., are varied will be exemplified, and the titanium alloy according to the present invention and the production process therefor will be described further in detail.

A. Test Sample Nos. 1–84

First of all, by using the production process of the titanium alloy according to the present invention, etc., Test Sample Nos. 1–84 were produced.

(1) Test Sample Nos. 1–13

Test Sample Nos. 1–3 relate to titanium alloys, which comprised 30–60% by weight of a Va group element and titanium.

① Test Sample No. 1

As raw material powders, commercially available hydride-dehydride Ti powders (–#325, –#100), which corresponded to a titanium powder set forth in the present invention, a niobium (Nb) powder (–#325), a vanadium (V) powder (–#325) and a tantalum (Ta) powder (–#325) were prepared. Note that, hereinafter, the aforesaid identical powders will be simply referred to as the "titanium powder", "niobium powder", "vanadium powder", "tantalum powder", and so on. Note that, the amount of the contained oxygen at this time was adjusted by the oxygen contained in the titanium powder. Moreover, note that the chemical compositions in Table 1 are expressed with % by weight, and that the descriptions on titanium being the balance are abbreviated.

These respective powders were prepared and mixed so as to be the composition ratio of Table 1 (mixing step). This mixture powder was subjected to the CIP (Cold Isostatic Pressing) at a pressure of 4 ton/cm$^2$, thereby obtaining a columnar green compact of $\phi$40×80 mm (compacting step). The green compact obtained by the compacting step was heated to sinter in a vacuum of $1\times10^{-5}$ torr at 1,300° C.×16 hours, thereby making a sintered body (sintering step). Moreover, this sintered body was subjected to hot working in air at 750–1,150° C. (hot working step), was made into a round bar of $\phi$10 mm, and was labeled as Test Sample No. 1.

② Test Sample No. 2

As raw materials, a sponge titanium, niobium of high purity and vanadium briquet were prepared. These raw materials were compounded in an amount of 1 kg so as to be the chemical composition of Table 1 (compounding step). These raw materials were melted by using an induction scull (melting step), were cast with a die (casting step), and thereafter an ingot material of $\phi$60×60 mm was obtained. Note that the melting treatment was carried out by 5 times of a re-melting treatment in order to homogenize. This ingot material was hot forged at 700–1,150° C. in air (hot working step), and was made into a round bar of $\phi$10 mm, and was labeled as Test Sample No. 2.

③ Test Sample No. 3 and Test Sample Nos. 8–11

As raw material powders, the titanium powder and the niobium powder, and the tantalum powder were used so as to be the chemical compositions of Table 1. Thereafter, the respective test samples were produced in the same manner as Test Sample No. 1.

④ Test Sample No. 7

As raw materials, a sponge titanium, niobium of high purity and tantalum briquet were prepared. These raw materials were compounded in an amount of 1 kg so as to be the chemical composition of Table 1 (compounding step). Thereafter, Test Sample No. 7 was produced in the same manner as Test Sample No. 2.

⑤ Test Sample Nos. 5, 6, 12 and 13

As raw material powders, the titanium powder and the niobium powder, the tantalum powder and the vanadium powder were used so as to be the chemical compositions of Table 1. Thereafter, the respective test samples were produced in the same manner as Test Sample No. 1.

(2) Test Sample Nos. 14–24

Test Sample Nos. 14–24 substituted zirconium, hafnium, and scandium for a part of the Va group element of Test Sample Nos. 6–10 and 12 as set forth in Table 2.

① Test Sample No. 14

Test Sample No. 14 substituted zirconium for a part of tantalum in Test Sample No. 9. As raw material powders, the titanium powder and the niobium powder, the tantalum powder and a zirconium (Zr) powder (–#325) were used so as to be the chemical composition of Table 2. Thereafter, Test Sample No. 14 was produced in the same manner as Test Sample No. 1.

② Test Sample No. 15

Test Sample No. 15 substituted zirconium for a part of niobium in Test Sample No. 7. As raw materials, a sponge titanium, niobium of high purity and tantalum briquet were prepared. These raw materials were compounded in an amount of 1 kg so as to be the chemical composition of Table 2 (compounding step). Thereafter, Test Sample No. 15 was produced in the same manner as Test Sample No. 2.

③ Test Sample No. 16

Test Sample No. 16 substituted zirconium for a part of niobium in Test Sample No. 10. As raw material powders, the titanium powder and the niobium powder, the tantalum powder and the zirconium powder were used so as to be the chemical composition of Table 2. Thereafter, Test Sample No. 16 was produced in the same manner as Test Sample No. 1.

④ Test Sample No. 17

Test Sample No. 17 substituted zirconium for a part of tantalum in Test Sample No. 10. As raw material powders, the titanium powder and the niobium powder, the tantalum powder and the zirconium powder were used so as to be the chemical composition of Table 2. Thereafter, Test Sample No. 17 was produced in the same manner as Test Sample No. 1.

⑤ Test Sample No. 18

Test Sample No. 18 substituted zirconium for tantalum in Test Sample No. 10. As raw material powders, the titanium powder and the niobium powder and the zirconium powder were used so as to be the chemical composition of Table 2. Thereafter, Test Sample No. 18 was produced in the same manner as Test Sample No. 1.

⑥ Test Sample No. 19

Test Sample No. 19 substituted zirconium for parts of niobium and tantalum in Test Sample No. 9. As raw material powders, the titanium powder and the niobium powder, the tantalum powder and the zirconium powder were used so as to be the chemical composition of Table 2. Thereafter, Test Sample No. 19 was produced in the same manner as Test Sample No. 1.

⑦ Test Sample No. 20

Test Sample No. 20 substituted zirconium for parts of niobium and vanadium in Test Sample No. 12. As raw material powders, the titanium powder and the niobium powder, the vanadium powder, the tantalum powder and the zirconium powder were used so as to be the chemical composition of Table 2. Thereafter, Test Sample No. 20 was produced in the same manner as Test Sample No. 1.

⑧ Test Sample No. 21

Test Sample No. 21 substituted zirconium and hafnium for a part of vanadium in Test Sample No. 6. As raw material powders, the titanium powder and the niobium powder, the vanadium powder, the tantalum powder, the zirconium powder and a hafnium (Hf) powder (–#325) were used so as to be the chemical composition of Table 2. Thereafter, Test Sample No. 21 was produced in the same manner as Test Sample No. 1.

⑨ Test Sample No. 22

Test Sample No. 22 substituted hafnium for parts of niobium and tantalum in Test Sample No. 10. As raw material powders, the titanium powder and the niobium powder, the tantalum powder and the hafnium powder were used so as to be the chemical composition of Table 2. Thereafter, Test Sample No. 22 was produced in the same manner as Test Sample No. 1.

⑩ Test Sample No. 23

Test Sample No. 23 substituted zirconium for a part of niobium in Test Sample No. 12. As raw material powders, the titanium powder and the niobium powder, the vanadium powder, the tantalum powder and the zirconium powder were used so as to be the chemical composition of Table 2. Thereafter, Test Sample No. 23 was produced in the same manner as Test Sample No. 1.

⑪ Test Sample No. 24

Test Sample No. 24 substituted scandium for parts of niobium and tantalum in Test Sample No. 9. As raw material powders, the titanium powder and the niobium powder, the tantalum powder and a scandium (Sc) powder (–#325) were used so as to be the composition ratio of Table 2. Thereafter, Test Sample No. 24 was produced in the same manner as Test Sample No. 1.

(3) Test Sample Nos. 25–31

Test Sample Nos. 25–31 were made by further adding chromium, manganese cobalt, nickel, molybdenum and iron to Test Sample Nos. 11, 14, 16, 17, 18 and 23.

① Test Sample No. 25

Test Sample No. 25 was made by adding chromium to Test Sample No. 23. As raw material powders, the titanium powder and the niobium powder, the vanadium powder, the tantalum powder, the zirconium powder and a chromium (Cr) powder (–#325) were used so as to be the chemical composition of Table 3. Thereafter, Test Sample No. 25 was produced in the same manner as Test Sample No. 1.

② Test Sample No. 26

Test Sample No. 26 was made by adding molybdenum to Test Sample No. 14. As raw material powders, the titanium powder, the niobium powder, the tantalum powder, the zirconium powder and a molybdenum (Mo) powder (–#325) were used so as to be the chemical composition of Table 3. Thereafter, Test Sample No. 26 was produced in the same manner as Test Sample No. 1.

③ Test Sample No. 27

Test Sample No. 27 was made by adding molybdenum to Test Sample No. 11. As raw material powders, the titanium powder and the niobium powder, the tantalum powder and the molybdenum powder were used so as to be the chemical composition of Table 3. Thereafter, Test Sample No. 27 was produced in the same manner as Test Sample No. 1.

④ Test Sample No. 28

Test Sample No. 28 was made by adding cobalt to Test Sample No. 18. As raw material powders, the titanium powder and the niobium powder, the zirconium powder and a cobalt (Co) powder (–#325) were used so as to be the chemical composition of Table 3. Thereafter, Test Sample No. 28 was produced in the same manner as Test Sample No. 1.

⑤ Test Sample No. 29

Test Sample No. 29 was made by adding nickel to Test Sample No. 16. As raw material powders, the titanium powder and the niobium powder, the tantalum powder, the zirconium powder and a nickel (Ni) powder (–#325) were used so as to be the chemical composition of Table 3. Thereafter, Test Sample No. 29 was produced in the same manner as Test Sample No. 1.

⑥ Test Sample No. 30

Test Sample No. 30 was made by adding manganese to Test Sample No. 17. As raw material powders, the titanium powder and the niobium powder, the tantalum powder, the zirconium powder and a manganese (Mn) powder (–#325) were used so as to be the chemical composition of Table 3. Thereafter, Test Sample No. 30 was produced in the same manner as Test Sample No. 1.

⑦ Sample No. 31

Test Sample No. 31 was made by adding iron to Test Sample No. 14. As raw material powders, the titanium powder and the niobium powder, the tantalum powder, the zirconium powder and an iron (Fe) powder (–#325) were used so as to be the chemical composition of Table 3. Thereafter, Test Sample No. 31 was produced in the same manner as Test Sample No. 1.

(4) Test Sample Nos. 32–38

Test Sample Nos. 32–34 were made by further compounding aluminum to Test Sample Nos. 14, 16 and 18. Test Sample No. 35–38 were made by further compounding tin (and aluminum) to Test Sample Nos. 8, 16 and 18.

① Test Sample No. 32

Test Sample No. 32 was made by adding aluminum to Test Sample No. 16. As raw material powders, the titanium powder and the niobium powder, the tantalum powder, the zirconium powder and an aluminum (Al) powder (–#325) were used so as to be the chemical composition of Table 3. Thereafter, Test Sample No. 32 was produced in the same manner as Test Sample No. 1.

② Test Sample No. 33

Test Sample No. 33 was made by adding aluminum to Test Sample No. 18. As raw material powders, the titanium powder and the niobium powder, the zirconium powder and the aluminum powder were used so as to be the chemical composition of Table 3. Thereafter, Test Sample No. 33 was produced in the same manner as Test Sample No. 1.

③ Test Sample No. 34

Test Sample No. 34 was made by adding aluminum to Test Sample No. 14. As raw material powders, the titanium powder and the niobium powder, the tantalum powder, the zirconium powder and an aluminum powder were used so as to be the composition ratio of Table 3. Thereafter, Test Sample No. 34 was produced in the same manner as Test Sample No. 1.

④ Test Sample No. 35

Test Sample No. 35 was made by adding tin to Test Sample No. 8. As raw material powders, the titanium powder and the niobium powder, the tantalum powder and a tin (Sn) powder (–#325) were used so as to be the chemical composition of Table 3. Thereafter, Test Sample No. 35 was produced in the same manner as Test Sample No. 1.

⑤ Test Sample No. 36

Test Sample No. 36 was made by adding tin to Test Sample No. 16. As raw material powders, the titanium powder and the niobium powder, the tantalum powder, the zirconium powder and the tin powder were used so as to be the chemical composition of Table 3. Thereafter, Test Sample No. 36 was produced in the same manner as Test Sample No. 1.

⑥ Test Sample No. 37

Test Sample No. 37 was made by adding tin to Test Sample No. 18. As raw material powders, the titanium powder and the niobium powder, the zirconium powder and the tin powder were used so as to be the chemical composition of Table 3. Thereafter, Test Sample No. 37 was produced in the same manner as Test Sample No. 1.

⑦ Test Sample No. 38

Test Sample No. 38 was made by adding tin and aluminum to Test Sample No. 16. As raw material powders, the titanium powder and the niobium powder, the tantalum powder, the zirconium powder, the tin powder and the aluminum powder were used so as to be the chemical composition of Table 3. Thereafter, Test Sample No. 38 was produced in the same manner as Test Sample No. 1.

(5) Test Sample Nos. 39–46

Test Sample Nos. 39–46 were actively varied the oxygen amounts contained in Test Sample Nos. 4, 10, 14, 17 and 18.

① Test Sample Nos. 39 and 40

Test Sample Nos. 39 and 40 increased the oxygen amount in Test Sample No. 4. As raw material powders, the titanium powder and the niobium powder and the tantalum powder were used so as to be the chemical compositions of Table 4. Thereafter, Test Sample Nos. 39 and 40 were produced in the same manner as Test Sample No. 1.

② Test Sample Nos. 41 and 42

Test Sample Nos. 41 and 42 increased the oxygen amount in Test Sample No. 10. As raw material powders, the titanium powder and the niobium powder and the tantalum powder were used so as to be the chemical compositions of Table 4. Thereafter, Test Sample Nos. 41 and 42 were produced in the same manner as Test Sample No. 1.

③ Test Sample Nos. 43 and 44

Test Sample Nos. 43 and 44 increased the oxygen amount in Test Sample No. 14. As raw material powders, the titanium powder and the niobium powder, the tantalum powder and the zirconium powder were used so as to be the chemical compositions of Table 4. Thereafter, Test Sample Nos. 43 and 44 were produced in the same manner as Test Sample No. 1.

④ Test Sample No. 45

Test Sample No. 45 increased the oxygen amount in Test Sample No. 18. As raw material powders, the titanium powder and the niobium powder, and the zirconium powder were used so as to be the chemical composition of Table 4. Thereafter, Test Sample No. 45 were produced in the same manner as Test Sample No. 1.

⑤ Test Sample No. 46

Test Sample No. 46 increased the oxygen amount in Test Sample No. 17. As raw material powders, the titanium powder and the niobium powder, the tantalum powder and the zirconium powder were used so as to be the chemical composition of Table 4. Thereafter, Test Sample No. 46 were produced in the same manner as Test Sample No. 1.

(6) Test Sample Nos. 47–54

Test Sample Nos. 47–54 were made by further adding carbon, nitrogen and boron in Test Sample Nos. 10, 16, 17 and 18.

① Test Sample Nos. 47 and 48

Test Sample Nos. 47 and 48 were made by adding carbon to Test Sample No. 18. As raw material powders, the titanium powder and the niobium powder, the zirconium powder and a TiC powder (–#325) were used so as to be the chemical compositions of Table 4. Thereafter, Test Sample Nos. 47 and 48 were produced in the same manner as Test Sample No. 1.

② Test Sample No. 49

Test Sample No. 49 was made by adding carbon to Test Sample No. 16. As raw material powders, the titanium powder and the niobium powder, the zirconium powder and the TiC powder were used so as to be the chemical composition of Table 4. Thereafter, Test Sample No. 49 were produced in the same manner as Test Sample No. 1.

③ Test Sample Nos. 50 and 51

Test Sample Nos. 50 and 51 were made by adding nitrogen to Test Sample No. 17. As raw material powders, the titanium powder and the niobium powder, the tantalum powder, the zirconium powder and a TiN powder (–#325) were used so as to be the chemical compositions of Table 4. Thereafter, Test Sample Nos. 50 and 51 were produced in the same manner as Test Sample No. 1.

④ Test Sample No. 52

Test Sample No. 52 were made by adding boron to Test Sample No. 17. As raw material powders, the titanium powder and the niobium powder, the tantalum powder, the zirconium powder and a $TiB_2$ powder (–#325) were used so as to be the chemical composition of Table 4. Thereafter, Test Sample No. 52 were produced in the same manner as Test Sample No. 1.

⑤ Test Sample No. 53

Test Sample No. 53 were made by adding boron to Test Sample No. 16. As raw material powders, the titanium powder and the niobium powder, the tantalum powder, the zirconium powder and the $TiB_2$ powder were used so as to be the chemical composition of Table 4. Thereafter, Test Sample No. 53 were produced in the same manner as Test Sample No. 1.

⑥ Test Sample No. 54

Test Sample No. 54 were made by adding boron to Test Sample No. 10. As raw material powders, the titanium powder and the niobium powder, the tantalum powder and a $TiB_2$ powder were used so as to be the chemical composition of Table 4. Thereafter, Test Sample No. 54 were produced in the same manner as Test Sample No. 1.

(7) Sample Nos. 55–74

Test Samples Nos. 55–74 were made by further carrying out the cold working onto Test Sample Nos. 2, 7, 14, 15, 16, 17, 18, 22, 26, 32 and 53.

① Test Sample No. 55

Test Sample No. 55 was made by carrying out the cold working onto Test Sample No. 2. As raw materials, a sponge titanium, niobium of high purity and vanadium briquet were prepared. These raw materials were compounded in an amount of 1 kg so as to be the chemical composition of Table 5A (compounding step). These raw materials were melted by using an induction scull (melting step), were cast with a die (casting step), and thereafter an ingot material of ϕ60×60 was obtained. Note that melting treatment was carried out by 5 times of a re-melting treatment in order to homogenize. This ingot material was hot forged at 700–1,150° C. in air (hot working step), and was made into a round bar of ϕ20 mm. This round bar of ϕ20 mm was subjected to the cold worked by a cold swaging machine, thereby producing Test Sample No. 55, which had the cold working ratio set forth in Table 5A.

② Test Sample No. 56

Test Sample No. 56 was made by carrying out the cold working onto Test Sample No. 7. As raw materials, a sponge titanium, niobium of high purity and tantalum briquet were prepared. These raw materials were compounded in an amount of 1 kg so as to be the chemical composition of Table 5A (compounding step) Thereafter, Test Sample No. 56, which had the cold working ratio set forth in Table 5A, was produced in the same manner as Test Sample No. 55.

③ Test Sample Nos. 57 and 58

Test Sample Nos. 57 and 58 were made by carrying out the cold working onto Test Sample No. 15. As raw materials, a sponge titanium, niobium of high purity, tantalum and zirconium briquet were prepared. These raw materials were compounded in an amount of 1 kg so as to be the chemical compositions of Table 5A (compounding step). Thereafter, Test Sample Nos. 57 and 58, which had cold working ratios set forth in Table 5A, were produced in the same manner as Test Sample No. 55.

④ Test Sample Nos. 59–62

Test Sample Nos. 59–62 were made by carrying out the cold working onto Test Sample No. 14. As raw material powders, the titanium powder and the niobium powder, the tantalum powder and the zirconium powder were used, and were prepared and mixed so as to be the composition ratio of Table 5A (mixing step). This mixture powder was subjected to the CIP (Cold Isostatic Pressing) at a pressure of 4 ton/cm$^2$, thereby obtaining a columnar green compact of ϕ40×80 mm (compacting step). The green compact obtained by the compacting step was heated to sinter in a vacuum of $1\times10^{-5}$ torr at 1,300° C.×16 hours, thereby making a sintered body (sintering step). Moreover, this sintered body was subjected to the hot working in air at 750–1,150° C. (hot working step), and was made into a round bar of ϕ20 mm. This round bar of ϕ20 mm was subjected to the cold working by a cold swaging machine, thereby producing Test Sample Nos. 59–62, which had the cold working ratios set forth in Table 5A.

⑤ Test Sample Nos. 63–66

Test Sample Nos. 63–66 were made by carrying out the cold working onto Test Sample No. 16. As raw material powders, the titanium powder and the niobium powder, the tantalum powder and the zirconium powder were used, and were prepared and mixed so as to be the chemical composition of Table 5A (mixing step). Thereafter, test samples, which had the cold working ratios set forth in Table 5A, were produced in the same manner as Test Sample No. 59.

⑥ Test Sample Nos. 67–70

Test Sample Nos. 67–70 were made by carrying out the cold working onto Test Sample No. 18. As raw material powders, the titanium powder and the niobium powder, and the zirconium powder were used, and were prepared and mixed so as to be the chemical composition of Table 5A (mixing step). Thereafter, test samples, which had the cold working ratios set forth in Table 5A, were produced in the same manner as Test Sample No. 59.

⑦ Test Sample Nos. 71–73

Test Sample No. 71 was made by carrying out the cold working onto Test Sample No. 53. As raw material powders, the titanium powder and the niobium powder, the tantalum powder, the zirconium powder and the $TiB_2$ powder were used, and were prepared and mixed so as to be the chemical composition of Table 5B (mixing step). Thereafter, test samples, which had the cold working ratio set forth in Table 5B, were produced in the same manner as Test Sample No. 59.

⑧ Test Sample No. 74.

Test Sample No. 74 was made by carrying out the cold working onto Test Sample No. 17. As raw material powders, the titanium powder and the niobium powder, the tantalum powder and the zirconium powder were used, and were prepared and mixed so as to be the chemical composition of Table 5B (mixing step). Thereafter, Test Sample No. 74, which had the cold working ratio set forth in Table 5B, was produced in the same manner as Test Sample No. 59.

⑨ Test Sample No. 75

Test Sample No. 75 was made by carrying out the cold working onto Test Sample No. 22. As raw material powders, the titanium powder and the niobium powder, the tantalum powder and the hafnium powder were used, and were prepared and mixed so as to be the chemical composition of Table 5B (mixing step). Thereafter, Test Sample No. 75, which had the cold working ratio set forth in Table 5S, was produced in the same manner as Test Sample No. 59.

⑩ Test Sample No. 76

Test Sample No. 76 was made by carrying out the cold working onto Test Sample No. 26. As raw material powders, the titanium powder and the niobium powder, the tantalum powder, the zirconium powder and the molybdenum powder were used, and were prepared and mixed so as to be the chemical composition of Table SB (mixing step). Thereafter, Test Sample No. 76, which had the cold working ratio set forth in Table 5B, was produced in the same manner as Test Sample No. 59.

⑪ Test Sample No. 77

Test Sample No. 77 was made by carrying out the cold working onto Test Sample No. 32. As raw material powders, the titanium powder and the niobium powder, the tantalum powder and the zirconium powder and the aluminum powder were used, and were prepared and mixed so as to be the chemical composition of Table 5B (mixing step). Thereafter, a test sample, which had the cold working ratio set forth in Table 5B, was produced in the same manner as Test Sample No. 59.

(8) Test Samples Nos. 78–81

Test Sample Nos. 78–81 were made by reducing the forming pressure of the CIP lower than those of the aforesaid respective test samples, thereby increasing the pore ratios in the sintered bodies.

① Test Sample No. 78 and 79

Test Sample Nos. 78 and 79 had the same chemical composition as that of Test Sample No. 8. As raw material powders, the titanium powder and the niobium powder, and the tantalum powder were prepared. Note that, at this time, the amount of the contained oxygen was adjusted by the oxygen, which was contained in the titanium powder.

These respective powders were prepared and mixed so as to be the chemical composition of Table 6 (mixing step). This mixture powder was subjected to the CIP (Cold Isostatic Pressing) at a pressure of 3.8 ton/cm$^2$ in making Test Sample No. 78, and at a pressure of 3.5 ton/cm$^2$ in making Test Sample No. 79, thereby obtaining columnar green compacts of $\phi$10×80 mm (compacting step). The green compacts obtained by the compacting step were heated to sinter in a vacuum of $1\times10^{-5}$ torr at 1,300° C.×16 hours, thereby making sintered bodies (sintering step), and these are labeled as Test Sample Nos. 78 and 79. Note that, when the pore ratios at this time were calculated, Test Sample No. 78 exhibited 2%, and Test Sample No. 79 exhibited 5%.

② Test Sample No. 80

Test Sample No. 80 had the same chemical composition as that of Test Sample No. 18. As raw material powders, the titanium powder and the niobium powder, and the zirconium powder were prepared. These respective powders were prepared and mixed so as to be the chemical composition of Table 6 (mixing step). This mixture powder was subjected to the CIP (Cold Isostatic Pressing) at a pressure of 3.0 ton/cm$^2$, thereby obtaining a columnar green compact of 10×80 mm (compacting step). The green compact obtained by the compacting step was heated to sinter in a vacuum of $1\times10^{-5}$ torr at 1,300° C.×16 hours, thereby making a sintered body (sintering step), and this is labeled as Test Sample No. 80. Note that, when the pore ratio at this time was calculated, it was 10%.

③ Test Sample No. 81

Test Sample No. 81 had the same chemical composition as that of Test Sample No. 16. As raw material powders, the titanium powder and the niobium powder, the tantalum powder and the zirconium powder were prepared. Note that, at this time, the amount of the contained oxygen was adjusted by the oxygen, which was contained in the titanium powder. These respective powders were prepared and mixed so as to be the composition ratio of Table 6 (mixing step). This mixture powder was subjected to the CIP (Cold Isostatic Pressing) at a pressure of 2.5 ton/cm$^2$, thereby obtaining a columnar green compact of $\phi$10×80 mm (compacting step). The green compact obtained by the forming step was heated to sinter in a vacuum of $1\times10^{-5}$ torr at 1,300° C.×16 hours, thereby making a sintered body (sintering step), and this was labeled as Test Sample No. 81. Note that, when the pore ratio at this time was calculated, it was 25%.

(9) Test Sample Nos. 82–84

Test Sample Nos. 82–84 produced titanium alloys by using the HIP method.

① Sample No. 82

As a raw material powder, a mixture powder, which was compounded so as to be the chemical composition of Table 6 by using the titanium powder, the niobium powder and the tantalum powder, was packed into a container made of pure titanium, and, after degassing by $1\times10^{-2}$ torr, the container was sealed (packing step). The container, in which the mixture powder was enclosed, was held under the condition of 1,000° C.×200 MPa for 2 hours, and was sintered by the HIP method (sintering step). The thus obtained $\phi$20×80 mm was labeled as Test Sample No. 82.

② Test Sample No. 83

The round bar of $\phi$20 mm, which was obtained as Test Sample No. 82, was subjected to the cold working by a cold swaging machine, thereby producing Test Sample No. 83, which had the cold working ratio set forth in Table 6.

③ Test Sample No. 84

Test Sample No. 84 was made by carrying out the cold working onto Test Sample No. 78. As raw material powders, the titanium powder and the niobium powder, and the tantalum powder were used, and were prepared and mixed so as to be the chemical composition of Table 6 (mixing step). This mixture powder was subjected to the CIP (Cold Isostatic Pressing) at a pressure of 3.8 ton/cm$^2$, thereby obtaining a columnar green compact of $\phi$20×80 mm (compacting step). The green compact obtained by the compacting step was heated to sinter in a vacuum of $1\times10^{-5}$ torr at 1,300° C.×16 hours, thereby making a sintered body (sintering step). This sintered body of $\phi$20 mm was subjected to the cold working by a cold swaging machine, thereby producing Test Sample No. 84, which had the cold working ratio set forth in Table 6.

B. Test Sample Nos. C1–C5 and Test Sample Nos. D1–D3

Next, Test Sample Nos. C1–C5 and Test Sample Nos. D1–D3, which had chemical compositions not belonging to the aforesaid chemical composition range, or which were obtained by processes being different from the aforesaid production processes, were produced.

(1) Test Sample Nos. C1–C5

① Test Sample No. C1 relates to a titanium alloy, in which the Va group element was less than 30% by weight. As raw material powders, the titanium powder and the niobium powder were prepared. The amount of the contained oxygen at this time was adjusted by the oxygen, which was contained in the titanium powder. These respective powders were prepared and mixed so as to be the chemical compositions of Table 7. The thus obtained mixture powder was subjected to the CIP (Cold Isostatic Pressing) at a pressure of 4 ton/cm$^2$, thereby obtaining a columnar green compact of $\phi$40×80 mm. This green compact was heated to sinter in a vacuum of $1\times10^{-5}$ torr at 1,300° C.×16 hours, thereby making a sintered body. Moreover, this sintered body was hot forged at 700–1,150° C. in air to make a round bar of $\phi$10 mm, and this was labeled as Test Sample No. C1.

② Test Sample No. C2

Test Sample No. C2 relates to a titanium alloy, in which the Va group element exceeded 60% by weight. As raw material powders, the titanium powder, the niobium powder, the vanadium powder and the tantalum powder were used, and were compounded so as to be the chemical composition of Table 7. Thereafter, Test Sample No. C2 was produced in the same manner as Test Sample No. C1.

③ Test Sample No. C3

Test Sample No. C3 relates to a titanium alloy, in which the aluminum exceeded 5% by weight. As raw material powders, the titanium powder, the niobium powder, the tantalum powder, the zirconium powder and the aluminum powder were used, and were compounded so as to be the chemical composition of Table 7. Thereafter, Test Sample No. C3 was produced in the same manner as Test Sample No. C1.

④ Test Sample No. C4

Test Sample No. C4 relates to a titanium alloy, in which the oxygen exceeded 0.6% by weight. As raw material powders, the titanium powder, the niobium powder and the tantalum powder were used, and were compounded so as to be the chemical composition of Table 7. Note that the amount of the contained oxygen was adjusted by the oxygen, which was contained in the titanium powder. Thereafter, Test Sample No. C4 was produced in the same manner as Test Sample No. C1.

⑤ Test Sample No. C5

Test Sample No. C5 relates to a titanium alloy, in which the boron exceeded 1.0% by weight. As raw material powders, the titanium powder, the niobium powder, the tantalum powder and the $TiB_2$ powder were used, and were compounded so as to be the chemical composition of Table 7. Thereafter, Test Sample No. C5 was produced in the same manner as Test Sample No. C5.

(2) Test Sample Nos. D1–D3

Test Sample Nos. D1–D3 were produced by the so-called melting process.

① Test Sample No. D1

As raw material powders, the titanium powder and the niobium powder, the hafnium powder and the tin powder was prepared, and were melted and made into a titanium alloy, whose component composition is set forth in Table 7, by the button melting. An ingot, which was thus obtained, was hot forged at 950–1,050° C. in air, and was made into a round bar of ϕ10×50 mm.

② Test Sample No. D2

As raw material powders, the titanium powder and the vanadium powder, and the aluminum powder were used, and were compounded so as to be the chemical composition of Table 7. Thereafter, Test Sample No. D2 was produced in the same manner as Test Sample No. D1.

③ Test Sample No. D3

As raw material powders, the titanium powder and the niobium powder, and the zirconium powder were used, and were compounded so as to be the chemical composition of Table 7. Thereafter, Test Sample No. D3 was produced in the same manner as Test Sample No. D1.

The Characteristics of the Respective Test Samples

On the aforesaid respective test samples, a variety of the characteristic values were determined by the methods set forth below.

① Average Young's Modulus, Tensile Elastic Limit Strength, Elastic Deformability and Tensile Strength On the respective test samples, a tensile test was carried out by using an Instron testing machine, the loads and the elongations were measured, and the stress-strain diagrams were determined.

As for the Instron testing machine, it was a universal tensile testing machine, which was made by Instron (a name of a maker), and its driving system was an electric-motor control system. The elongations were measured by outputs of a strain gage, which was bonded on a side surface of the test pieces.

As for the average Young's modulus, the tensile elastic limit strength and the tensile strength, they were determined by the aforementioned methods based on the stress-strain diagrams. Moreover, the elastic deformability was determined by figuring strains, which corresponded to the tensile elastic limit strengths, from the stress-strain diagrams.

② Others

The pore ratio means the volume % of the aforesaid pores, and the cold working ratio means the cold working ratio, which was determined by the above-described equation.

These results are set forth in Table 1–Table 7 all together.

TABLE 1

| Test Sample | Composition of Titanium Alloy (% by weight-Balance: Ti) Va Group Element | | | | | | | | | | | | | | | | | | | *1 *2 | *3 | *4 | *5 | |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | Remarks |
| 1 | 20 | 2 | 8 | 30 | | | | | | | | | | | | 0.22 | | | | 74 | 703 | 1.3 | 721 | |
| 2 | 27 | 4 | | 31 | | | | | | | | | | | | 0.10 | | | | 74 | 705 | 1.3 | 729 | |
| 3 | 25 | | 8 | 33 | | | | | | | | | | | | 0.19 | | | | 69 | 715 | 1.4 | 736 | |
| 4 | 30 | | 5 | 35 | | | | | | | | | | | | 0.23 | | | | 67 | 725 | 1.4 | 745 | |
| 5 | 30 | 2 | 5 | 37 | | | | | | | | | | | | 0.29 | | | | 65 | 730 | 1.4 | 758 | |
| 6 | 25 | 8 | 6 | 39 | | | | | | | | | | | | 0.28 | | | | 64 | 732 | 1.5 | 759 | |
| 7 | 30 | | 10 | 40 | | | | | | | | | | | | 0.11 | | | | 62 | 707 | 1.5 | 730 | |
| 8 | 30 | | 10 | 40 | | | | | | | | | | | | 0.26 | | | | 64 | 735 | 1.5 | 761 | |
| 9 | 37 | | 6 | 43 | | | | | | | | | | | | 0.27 | | | | 59 | 721 | 1.5 | 746 | |
| 10 | 35 | | 10 | 45 | | | | | | | | | | | | 0.22 | | | | 58 | 728 | 1.6 | 751 | |
| 11 | 35 | | 13 | 48 | | | | | | | | | | | | 0.27 | | | | 62 | 735 | 1.5 | 762 | |
| 12 | 40 | 6 | 4 | 50 | | | | | | | | | | | | 0.28 | | | | 65 | 721 | 1.4 | 745 | |
| 13 | 30 | 7 | 4 | 41 | | | | | | | | | | | | 0.35 | | | | 72 | 715 | 1.3 | 739 | |

Notes:
*1 stands for "Material Characteristics".
*2 stands for "Average Young's Modulus".
*3 stands for "Tensile Elastic Limit Strength".
*4 stands for "Elastic Deformability".
*5 stands for "Tensile Strength".

TABLE 2

| Test Sample | Composition of Titanium Alloy (% by weight-Balance: Ti) Va Group Element | | | | | | | | | | | | | | | | | | | *1 *2 | *3 | *4 | *5 | |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | Remarks |
| 14 | 37 | | 3 | 40 | 3 | | | | | | | | | | | 0.28 | | | | 58 | 731 | 1.6 | 757 | *6 |
| 15 | 25 | | 10 | 35 | 5 | | | | | | | | | | | 0.11 | | | | 57 | 721 | 1.6 | 745 | *7 |
| 16 | 30 | | 10 | 40 | 5 | | | | | | | | | | | 0.26 | | | | 57 | 735 | 1.6 | 764 | *8 |
| 17 | 35 | | 2 | 37 | 8 | | | | | | | | | | | 0.25 | | | | 55 | 745 | 1.7 | 775 | *9 |
| 18 | 35 | | | 35 | 10 | | | | | | | | | | | 0.25 | | | | 56 | 742 | 1.6 | 765 | *10 |

TABLE 2-continued

| Test Sample | Composition of Titanium Alloy (% by weight-Balance: Ti) Va Group Element | | | | | | | | | | | | | | | | | | | *2 | *1 *3 | *4 | *5 | |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | Remarks |
| 19 | 26 | | 4 | 30 | 13 | | | | | | | | | | | 0.26 | | | | 58 | 742 | 1.6 | 772 | *11 |
| 20 | 23 | 5 | 4 | 32 | 18 | | | | | | | | | | | 0.27 | | | | 63 | 741 | 1.5 | 776 | *12 |
| 21 | 25 | 3 | 6 | 34 | 2 | 3 | | | | | | | | | | 0.28 | | | | 61 | 735 | 1.5 | 764 | *13 |
| 22 | 33 | | 7 | 40 | | 5 | | | | | | | | | | 0.22 | | | | 55 | 737 | 1.6 | 759 | *14 |
| 23 | 30 | 6 | 4 | 40 | 10 | | | | | | | | | | | 0.27 | | | | 62 | 728 | 1.5 | 758 | *15 |
| 24 | 35 | | 5 | 40 | | | 3 | | | | | | | | | 0.27 | | | | 57 | 729 | 1.6 | 761 | *16 |

*1 stands for "Material Characteristics".
*2 stands for "Average Young's Modulus".
*3 stands for "Tensile Elastic Limit Strength".
*4 stands for "Elastic Deformability".
*5 stands for "Tensile Strength".
*6 stands for "A Part of Ta in No. 9 - Zr".
*7 stands for "A Part of Nb in No. 7 - Zr".
*8 stands for "A Part of Nb in No. 10 - Zr".
*9 stands for "A Part of Ta in No. 10 - Zr".
*10 stands for "Ta in No. 10 - Zr".
*11 stands for "Parts of Nb & Ta in No. 9 - Zr".
*12 stands for "Parts of Nb & V in No. 12 - Zr".
*13 stands for "A Part of V in No. 6 - Zr and Hf".
*14 stands for "Parts of Nb & Ta in No. 10 - Zr".
*15 stands for "A Part of Nb in No. 12 - Zr".
*16 stands for "Parts of Nb & Ta in No. 9 - Sc".

TABLE 3

| Test Sample | Composition of Titanium Alloy (% by weight-Balance: Ti) Va Group Element | | | | | | | | | | | | | | | | | | | *2 | *1 *3 | *4 | *5 | |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | Remarks |
| 25 | 30 | 6 | 4 | 40 | 10 | | | | 2 | | | | | | | 0.27 | | | | 62 | 743 | 1.5 | 776 | *6 |
| 26 | 37 | | 3 | 40 | 3 | | | | | 3 | | | | | | 0.28 | | | | 57 | 753 | 1.6 | 785 | *7 |
| 27 | 35 | | 13 | 48 | | | | | | 8 | | | | | | 0.27 | | | | 63 | 764 | 1.5 | 795 | *8 |
| 28 | 35 | | | 35 | 10 | | | | | | 3 | | | | | 0.25 | | | | 59 | 745 | 1.6 | 776 | *9 |
| 29 | 30 | | 10 | 40 | 5 | | | | | | | 2 | | | | 0.26 | | | | 57 | 748 | 1.6 | 783 | *10 |
| 30 | 35 | | 2 | 37 | 8 | | | | | | | | 2 | | | 0.25 | | | | 55 | 753 | 1.7 | 787 | *11 |
| 31 | 37 | | 3 | 40 | 3 | | | | | | | | | 4 | | 0.26 | | | | 61 | 749 | 1.5 | 775 | *12 |
| 32 | 30 | | 10 | 40 | 5 | | | | | | | | | | 0.5 | 0.23 | | | | 61 | 747 | 1.5 | 768 | *13 |
| 33 | 35 | | | 35 | 10 | | | | | | | | | | 1.5 | 0.25 | | | | 63 | 759 | 1.5 | 791 | *14 |
| 34 | 37 | | 3 | 40 | 3 | | | | | | | | | | 3.5 | 0.28 | | | | 69 | 790 | 1.5 | 817 | *15 |
| 35 | 30 | | 10 | 40 | | | | 2 | | | | | | | | 0.26 | | | | 64 | 745 | 1.5 | 770 | *16 |
| 36 | 30 | | 10 | 40 | 5 | | | 4 | | | | | | | | 0.23 | | | | 60 | 761 | 1.6 | 791 | *17 |
| 37 | 35 | | | 35 | 10 | | | 7 | | | | | | | | 0.25 | | | | 63 | 771 | 1.5 | 801 | *18 |
| 38 | 30 | | 10 | 40 | 5 | | | 2 | | | | | | | 1.5 | 0.24 | | | | 65 | 774 | 1.5 | 826 | *19 |

Notes
*1 stands for "Material Characteristics".
*2 stands for "Average Young's Modulus".
*3 stands for "Tensile Elastic Limit Strength".
*4 stands for "Elastic Deformability".
*5 stands for "Tensile Strength".
*6 stands for "Cr was added to No. 23".
*7 stands for "Mo was added to No. 14".
*8 stands for "Mo was added to No. 11".
*9 stands for "Co was added to No. 18".
*10 stands for "Ni was added to No. 16".
*11 stands for "Mn was added to No. 17"
*12 stands for "Fe was added to No. 14".
*13 stands for "Al was added to No. 16".
*14 stands for "Al was added to No. 18".
*15 stands for "Al was added to No. 14".
*16 stands for "Sn was added to No. 8".
*17 stands for "Sn was added to No. 16".
*18 stands for "Sn was added to No. 18".
*19 stands for "Sn & Al were added to No. 16".

TABLE 4

| Test Sample | Composition of Titanium Alloy (% by weight-Balance Ti) Va Group Element | | | | | | | | | | | | | | | |
|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O |
| 39 | 30 | | 5 | 35 | | | | | | | | | | | | 0.35 |
| 40 | 30 | | 5 | 35 | | | | | | | | | | | | 0.41 |
| 41 | 35 | | 10 | 45 | | | | | | | | | | | | 0.38 |
| 42 | 35 | | 10 | 45 | | | | | | | | | | | | 0.52 |
| 43 | 37 | | 3 | 40 | 3 | | | | | | | | | | | 0.37 |
| 44 | 37 | | 3 | 40 | 3 | | | | | | | | | | | 0.55 |
| 45 | 35 | | | 35 | 10 | | | | | | | | | | | 0.36 |
| 46 | 35 | | 2 | 37 | 8 | | | | | | | | | | | 0.57 |
| 47 | 35 | | | 35 | 10 | | | | | | | | | | | 0.26 |
| 48 | 35 | | | 35 | 10 | | | | | | | | | | | 0.26 |
| 49 | 30 | | 10 | 40 | 5 | | | | | | | | | | | 0.22 |
| 50 | 35 | | 2 | 37 | 8 | | | | | | | | | | | 0.25 |
| 51 | 35 | | 2 | 37 | 8 | | | | | | | | | | | 0.25 |
| 52 | 35 | | 2 | 37 | 8 | | | | | | | | | | | 0.25 |
| 53 | 30 | | 10 | 40 | 5 | | | | | | | | | | | 0.22 |
| 54 | 35 | | 10 | 45 | | | | | | | | | | | | 0.22 |

| Test Sample | Composition of Titanium Alloy (% by weight-Balance Ti) Va Group Element | | | *2 | *1 *3 | *4 | *5 | |
|---|---|---|---|---|---|---|---|---|
| No. | C | N | B | (GPa) | (MPa) | (%) | (MPa) | Remarks |
| 39 | | | | 67 | 741 | 1.4 | 765 | *6 |
| 40 | | | | 69 | 763 | 1.4 | 791 | *7 |
| 41 | | | | 64 | 767 | 1.5 | 793 | *8 |
| 42 | | | | 65 | 815 | 1.6 | 846 | *9 |
| 43 | | | | 62 | 760 | 1.5 | 795 | *10 |
| 44 | | | | 66 | 823 | 1.6 | 851 | *11 |
| 45 | | | | 60 | 777 | 1.6 | 803 | *12 |
| 46 | | | | 66 | 823 | 1.6 | 854 | *13 |
| 47 | 0.22 | | | 65 | 785 | 1.5 | 811 | *14 |
| 48 | 0.65 | | | 71 | 833 | 1.5 | 863 | *15 |
| 49 | 0.21 | | | 65 | 773 | 1.5 | 806 | *16 |
| 50 | | 0.21 | | 64 | 776 | 1.6 | 807 | *17 |
| 51 | | 0.55 | | 73 | 814 | 1.3 | 829 | *18 |
| 52 | | | 0.05 | 60 | 778 | 1.6 | 806 | *19 |
| 53 | | | 0.37 | 69 | 827 | 1.5 | 853 | *20 |
| 54 | | | 0.82 | 74 | 848 | 1.4 | 876 | *21 |

Notes
*1 stands for "Material Characteristics".
*2 stands for "Average Young's Modulus".
*3 stands for "Tensile Elastic Limit Strength".
*4 stands for "Elastic Deformability".
*5 stands for "Tensile Strength".
*6 stands for "O in No. 4 was increased".
*7 stands for "O in No. 4 was increased".
*8 stands for "O in No. 10 was increased".
*9 stands for "O in No. 10 .was increased".
*10 stands for "O in No. 14 was increased".
*11 stands for "O in No. 14 was increased"
*12 stands for "O in No. 18 was increased".
*13 stands for "O in No. 17 was increased".
*14 stands for "C was added to No. 18".
*15 stands for "C was added to No. 18".
*16 stands for "C was added to No. 16".
*17 stands for "N was added to No. 17".
*18 stands for "N was added to No. 17".
*19 stands for "B was added to No. 17".
*20 stands for "B was added to No. 16".
*21 stands for "B was added to No. 10".

TABLE 5A

| Test Sample | Composition of Titanium Alloy (% by weight-Balance: Ti) Va Group Element | | | | | | | | | | | | | | | | | | | *2 | *1 *3 | *4 | *5 | |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | Remarks |
| 55 | 27 | 4 | | 31 | | | | | | | | | | | | 0.10 | | | | 69 | 752 | 1.4 | 783 | *6 |
| 56 | 30 | | 10 | 40 | | | | | | | | | | | | 0.11 | | | | 60 | 765 | 1.6 | 792 | *7 |
| 57 | 25 | | 10 | 35 | 5 | | | | | | | | | | | 0.11 | | | | 56 | 788 | 1.8 | 826 | *8 |
| 58 | 25 | | 10 | 35 | 5 | | | | | | | | | | | 0.11 | | | | 54 | 846 | 1.9 | 883 | *9 |
| 59 | 37 | | 3 | 40 | 3 | | | | | | | | | | | 0.28 | | | | 57 | 780 | 1.7 | 806 | *10 |
| 60 | 37 | | 3 | 40 | 3 | | | | | | | | | | | 0.28 | | | | 54 | 836 | 1.9 | 866 | *11 |
| 61 | 37 | | 3 | 40 | 3 | | | | | | | | | | | 0.28 | | | | 51 | 987 | 2.3 | 1037 | *12 |
| 62 | 37 | | 3 | 40 | 3 | | | | | | | | | | | 0.28 | | | | 48 | 1035 | 2.5 | 1080 | *13 |
| 63 | 30 | | 10 | 40 | 5 | | | | | | | | | | | 0.26 | | | | 56 | 775 | 1.7 | 811 | *14 |
| 64 | 30 | | 10 | 40 | 5 | | | | | | | | | | | 0.26 | | | | 54 | 835 | 1.9 | 869 | *15 |
| 65 | 30 | | 10 | 40 | 5 | | | | | | | | | | | 0.26 | | | | 49 | 897 | 2.2 | 933 | *16 |
| 66 | 30 | | 10 | 40 | 5 | | | | | | | | | | | 0.26 | | | | 44 | 985 | 2.6 | 1025 | *17 |
| 67 | 35 | | | 35 | 10 | | | | | | | | | | | 0.25 | | | | 54 | 778 | 1.8 | 820 | *18 |
| 68 | 35 | | | 35 | 10 | | | | | | | | | | | 0.25 | | | | 50 | 837 | 2.0 | 872 | **19 |
| 69 | 35 | | | 35 | 10 | | | | | | | | | | | 0.25 | | | | 48 | 894 | 2.2 | 935 | *20 |
| 70 | 35 | | | 35 | 10 | | | | | | | | | | | 0.25 | | | | 44 | 996 | 2.6 | 1038 | *21 |

Notes
*1 stands for "Material Characteristics".
*2 stands for "Average Young's Modulus".
*3 stands for "Tensile Elastic Limit Strength".
*4 stands for "Elastic Deformability".
*5 stands for "Tensile Strength".
*6 stands for "No. 2: Cold Working Ratio 30%".
*7 stands for "No. 7: Cold Working Ratio 25%".
*8 stands for "No. 15: Cold Working Ratio 40%".
*9 stands for "No. 15: Cold Working Ratio 60%".
*10 stands for "No. 14: Cold Working Ratio 15%".
*11 stands for "No. 14: Cold Working Ratio 51%"
*12 stands for "No. 14: Cold Working Ratio 75%".
*13 stands for "No. 14: Cold Working Ratio 95%".
*14 stands for "No. 16: Cold Working Ratio 15%".
*15 stands for "No. 16: Cold Working Ratio 53%".
*16 stands for "No. 16: Cold Working Ratio 75%".
*17 stands for "No. 16: Cold Working Ratio 95%".
*18 stands for "No. 18: Cold Working Ratio 22%".
*19 stands for "No. 18: Cold Working Ratio 59%".
*20 stands for "No. 18: Cold Working Ratio 77%".
*21 stands for "No. 18: Cold Working Ratio 95%".

TABLE 5B

| Test Sample | Composition of Titanium Alloy (% by weight-Balance: Ti) Va Group Element | | | | | | | | | | | | | | | | | | | *2 | *1 *3 | *4 | *5 | Re- |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | marks |
| 71 | 30 | | 10 | 40 | 5 | | | | | | | | | | | 0.22 | | | 0.37 | 67 | 859 | 1.6 | 935 | *6 |
| 72 | 30 | | 10 | 40 | 5 | | | | | | | | | | | 0.22 | | | 0.37 | 65 | 907 | 1.7 | 987 | *7 |
| 73 | 30 | | 10 | 40 | 5 | | | | | | | | | | | 0.22 | | | 0.37 | 63 | 947 | 1.8 | 1030 | *8 |
| 74 | 35 | | 2 | 37 | 8 | | | | | | | | | | | 0.25 | | | | 46 | 912 | 2.3 | 945 | *9 |
| 75 | 33 | | 7 | 40 | | 5 | | | | | | | | | | 0.22 | | | | 52 | 879 | 2 | 915 | *10 |
| 76 | 37 | | 3 | 40 | 3 | | | | | | | | 3 | | | 0.28 | | | | 55 | 984 | 2.2 | 1026 | *11 |
| 77 | 30 | | 10 | 40 | 5 | | | | | | | | | | 0.5 | 0.23 | | | | 59 | 876 | 1.9 | 911 | *12 |

*1 stands for "Material Characteristics".
*2 stands for "Average Young's Modulus".
*3 stands for "Tensile Elastic Limit Strength".
*4 stands for "Elastic Deformability".
*5 stands for "Tensile Strength".
*6 stands for "No. 53: Cold Working Ratio 50%".
*7 stands for "No. 53: Cold Working Ratio 75%".
*8 stands for "No. 53: Cold Working Ratio 95%".
*9 stands for "No. 17: Cold Working Ratio 90%".
*10 stands for "No. 22: Cold Working Ratio 75%".
*11 stands for "No. 26: Cold Working Ratio 95%".
*12 stands for "No. 32: Cold Working Ratio 75%".

TABLE 6

| Test Sample | Composition of Titanium Alloy (% by weight-Balance: Ti) Va Group Element | | | | | | | | | | | | | | | | | | | *2 | *1 *3 | *4 | *5 | |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | Remarks |
| 78 | 30 | | 10 | 40 | | | | | | | | | | | | 0.26 | | | | 60 | 724 | 1.5 | 731 | *6 |
| 79 | 30 | | 10 | 40 | | | | | | | | | | | | 0.26 | | | | 56 | 721 | 1.6 | 725 | *7 |
| 80 | 35 | | | 35 | 10 | | | | | | | | | | | 0.25 | | | | 50 | 708 | 1.7 | 422 | *8 |
| 81 | 30 | | 10 | 40 | 5 | | | | | | | | | | | 0.26 | | | | 48 | 705 | 1.8 | 711 | *9 |
| 82 | 30 | | 5 | 35 | | | | | | | | | | | | 0.21 | | | | 66 | 743 | 1.4 | 776 | *10 |
| 83 | 30 | | 5 | 35 | | | | | | | | | | | | 0.21 | | | | 56 | 997 | 2.1 | 1055 | *11 |
| 84 | 30 | | 10 | 40 | | | | | | | | | | | | 0.35 | | | | 58 | 986 | 2.1 | 1033 | *12 |

*1 stands for "Material Characteristics".
*2 stands for "Average Young's Modulus".
*3 stands for "Tensile Elastic Limit Strength".
*4 stands for "Elastic Deformability".
*5 stands for "Tensile Strength".
*6 stands for "No. 8: Pore Ratio 2%".
*7 stands for "No. 8: Pore Ratio 5%".
*8 stands for "No. 18: Pore Ratio 10%".
*9 stands for "No. 16: Pore Ratio 25%".
*10 stands for "As it was subjected to HIP".
*11 stands for "HIP + Cold Working Ratio 95%".
*12 stands for "Sintering + Cold Working Ratio 95%".

TABLE 7

| Test Sample | Composition of Titanium Alloy (% by weight-Balance: Ti) Va Group Element | | | | | | | | | | | | | | | | | | | *2 | *1 *3 | *4 | *5 | |
|---|---|---|---|---|---|---|---|---|---|---|---|---|---|---|---|---|---|---|---|---|---|---|---|---|
| No. | Nb | V | Ta | Sum | Zr | Hf | Sc | Sn | Cr | Mn | Co | Ni | Mo | Fe | Al | O | C | N | B | (GPa) | (MPa) | (%) | (MPa) | Remarks |
| C1 | 25 | | | 25 | | | | | | | | | | | | 0.27 | | | | 77 | 669 | 0.9 | 683 | *6 |
| C2 | 45 | 7 | 10 | 62 | | | | | | | | | | | | 0.28 | | | | 78 | 675 | 0.9 | 691 | *7 |
| C3 | 37 | | 3 | 40 | 3 | | | | | | | | | | 5.2 | 0.26 | | | | 79 | 935 | 1.0 | 944 | *8 |
| C4 | 35 | | 10 | 45 | | | | | | | | | | | | 0.66 | | | | 78 | 874 | 1.0 | 879 | *9 |
| C5 | 35 | | 10 | 45 | | | | | | | | | | | | 0.23 | | | 1.2 | 85 | 958 | 1.0 | 965 | *10 |
| D1 | 20 | | | 20 | | 5 | | 5 | | | | | | | | 0.25 | | | | 115 | 1030 | 0.9 | 1210 | |
| D2 | | 4 | | 4 | | | | | | | | | | | 6 | 0.14 | | | | 115 | 830 | 0.7 | 895 | |
| D3 | 13 | | | 13 | 13 | | | | | | | | | | | 0.11 | | | | 81 | 864 | 1.0 | 994 | |

*1 stands for "Material Characteristics".
*2 stands for "Average Young's Modulus".
*3 stands for "Tensile Elastic Limit Strength".
*4 stands for "Elastic Deformability".
*5 stands for "Tensile Strength".
*6 stands for "Nb + V + Ta < 30%".
*7 stands for "Nb + V + Ta > 60%".
*8 stands for "Al > 5%".
*9 stands for "O > 0.6%".
*10 stands for "B > 1.0%.

Evaluation of the Respective Test Samples

① On Average Young's Modulus and Tensile Elastic Limit Strength

All Test Sample Nos. 1–13 contained the Va group elements of 30–60% by weight, the average Young's moduluses were 75 GPa or less, and the tensile elastic limit strengths were 700 MPa or more. Accordingly, it is understood that the sufficiently low Young's modulus and the high strength (high elasticity) were achieved.

While, in Test Sample No. C1 and Test Sample Nos. D1–D3 whose Va element contents were less than 30% by weight, and in Test Sample No. C2 whose Va group element exceeded 60%, all of them exhibited the Young's moduluses, which exceeded 75 GPa, and the low Young's modulus was not achieved.

Next, by comparing Test Sample Nos. 14–24, in which Zr, Hf or Sc was contained in the predetermined amounts of the Va group elements, with Test Sample Nos. 6–12, it is apparent that Test Sample Nos. 14–24 were intended to exhibit the further lowered Young's moduluses and the further heightened strengths (heightened elasticity) in all of the cases.

Further, when comparing Test Sample Nos. 25–38, in which Cr, Mo, Mn, Fe, Co, Ni, Al or Sn was contained, with the test samples, which were free from these element, they were improved in terms of the tensile elastic limit strength while accomplishing the low Young's modulus. Therefore, it is understood that these elements are effective to heighten the strength (to heighten the elasticity) of the titanium alloy according to the present invention.

However, as can be seen from Test Sample No. C3, etc., although the tensile elastic limit strengths were improved when the content of Al exceeded 5% by weight, the increments of the average Young's moduluses were brought about. It is understood that the content of Al is preferably 5% by weight or less in order to be the low Young's modulus and the high strength (high elasticity).

Furthermore, it is understood from Test Sample Nos. 39–46 that the oxygen is an effective element to intend in lowering the Young's modulus and in heightening the strength (in heightening the elasticity). Moreover, it is understood from Test Sample Nos. 47–51 that, concerning the carbon and the nitrogen, they are similarly effective elements to intend the low Young's modulus and the high strength (high elasticity).

In addition, it is understood from Test Sample Nos. 52–54 that the boron is also an effective element to intend in lowering the Young's modulus and in heightening the strength (in heightening the elasticity). Besides, it is understood from Test Sample Nos. 71–73 that the cold workability is not impaired by adding the proper amount of the boron.

② Elastic Deformability

All of Test Sample Nos. 1–84 exhibited the deformabilities of 1.3 or more, and it is understood that they had the excellent deformabilities with respect to Test Sample Nos. C1–C5 and D1–D3 (the elastic deformabilities were 1.0 or less).

③ On Cold Working Ratio

It is understood in general from Test Sample Nos. 55–77, which were subjected to the cold working, that the Young's modulus tended to decrease, and that the tensile elastic limit strength tended to increase as the cold working ratio heightened. It is understood that the cold working is effective in making the lowering of the Young's modulus and heightening of the elastic deformability of the titanium alloy as well as the heightening of the strength (heightening the elasticity) compatible.

④ On Pore Ratio

It is understood from Test Sample Nos. 78–81 that, even when the pores of 30% by volume or less existed, the high strengths (high elasticity) were obtained in addition to the low Young's moduluses. And, in Test Sample Nos. 80 and 81 whose pore ratios were further enlarged, the improvement of the specific strengths was intended by the decrement of the densities.

⑤ On Sintering Process and Melting Process

By comparing the test samples of Test Sample Nos. 1–84, which were produced by the sintering process, with Test Sample Nos. D1–D3, which were produced by the melting process, it is understood that it was likely to obtain titanium alloys, which exhibited the low Young's moduluses, the high elastic deformabilities and the high strengths (high elasticities), by the sintering process.

While, like Test Sample Nos. D1–D3, in titanium alloys, which were obtained by the melting process, it is difficult to make the low Young's modulus and the high strength (high elasticity) compatible. However, this does not mean, as can be seen from Test Sample Nos. 2, 7, etc., that titanium alloys, which are produced by the melting process, are excluded from the present invention.

As having described so far, the titanium alloy of the present invention can be used widely in a variety of products, which are required to exhibit a low Young's modulus, a high elastic deformability and a high strength (high elasticity), moreover, since it is excellent in terms of the cold workability, it is possible to intend the improvement of the productivity.

In addition, in accordance with the titanium alloy production process of the present invention, it is possible to readily obtain such a titanium alloy.

What is claimed is:

1. A titanium alloy characterized in that said titanium alloy comprises an element of Va group (the vanadium group) in an amount of 30–60% by weight and the balance of titanium substantially, exhibits an average Young's modulus of 75 GPa or less, exhibits a tensile elastic limit strength of 700 MPa or more, and the gradient of the tangential line in a stress-strain diagram obtained by a tensile test within an elastic deformation range, in which the stress ranges from 0 to the tensile elastic limit strength, decreases continuously with increase in stress.

2. The titanium alloy set forth in claim 1 further comprising:

one or more elements selected from the metallic element group consisting of chromium (Cr), molybdenum (Mo), manganese (Mn), iron (Fe), cobalt (Co) and nickel (Ni), wherein said chromium and said-molybdenum constitute 20% by weight or less, respectively, and said manganese, said iron, said cobalt and'said nickel constitute 10% by weight or less, respectively, aluminum (Al) in an amount of 0.3–5% by weight; or a combination thereof, when the entirety is taken as 100% by weight.

3. The titanium alloy set forth in claim 1, wherein one or more elements selected from the metallic element group consisting of zirconium (Zr), hafnium (Hf) and scandium (Sc) are contained in a summed amount of 20% by weight or less when the entirety is taken as 100% by weight.

4. The titanium alloy set forth in claim 3 further comprising:

one or more elements selected from the metallic element group consisting of chromium (Cr), molybdenum (Mo), manganese (Mn), iron (Fe), cobalt (Co) and nickel (Ni), wherein said chromium and said molybdenum constitute 20% by weight or less, respectively, and said manganese, said iron, said cobalt and said nickel constitute 10% by weight or less, respectively, aluminum (Al) in an amount of 0.3–5% by weight; or a combination thereof, when the entirety is taken as 100% by weight.

5. The titanium alloy set forth in claim 1 containing oxygen (O) in an amount of 0.08–0.6% by weight when the entirety is taken as 100% by weight.

6. The titanium alloy set forth in claim 5, further comprising at least one element selected from the group consisting of:

carbon (C) in an amount of 0.05–1.0% by weight;

nitrogen (N) in an amount of 0.05–0.8% by weight; and boron (B) in an amount of 0.01 to 1.0% by weight, when the entirety is taken as 100% by weight.

7. The titanium alloy set forth in claim 6 having a cold working structure of 10% or more, exhibiting an average Young's modulus of 70 GPa or less, and exhibiting a tensile elastic limit strength of 750 MPa or more.

8. The titanium alloy set forth in claim 5, further comprising at least one element selected from the group consisting of:

carbon (C) in an amount of 0.05–1.0% by weight; and nitrogen (N) in an amount of 0.05–0.8% by weight; when the entirety is taken as 100% by weight.

9. The titanium alloy set forth in claim 8 having said cold working structure of 50% or more, exhibiting the average Young's modulus of 65 GPa or less, and exhibiting the tensile elastic limit strength of 800 MPa or more.

10. The titanium alloy set forth in claim 9 having said cold working structure of 70% or more, exhibiting the average Young's modulus of 60 GPa or less, and exhibiting the tensile elastic limit strength of 850 MPa or more.

11. The titanium alloy set forth in claim 10 having said cold working structure of 90% or more, exhibiting the average Young's modulus of 55 GPa or less, and exhibiting the tensile elastic limit strength of 900 MPa or more.

12. The titanium alloy set forth in claim 5 having a cold working structure of 10% or more, exhibiting an average Young's modulus of 70 GPa or less, and exhibiting a tensile elastic limit strength of 750 MPa or more.

13. The titanium alloy set forth in claim 12 having said cold working structure of 50% or more, exhibiting the average Young's modulus of 65 GPa or less, and exhibiting the tensile elastic limit strength of 800 MPa or more.

14. The titanium alloy set forth in claim 13 having said cold working structure of 70% or more, exhibiting the average Young's modulus of 60 GPa or less, and exhibiting the tensile elastic limit strength of 850 MPa or more.

15. The titanium alloy set forth in claim 14 having said cold working structure of 90% or more, exhibiting the average Young's modulus of 55 GPa or less, and exhibiting the tensile elastic limit strength of 900 MPa or more.

16. The titanium alloy set forth in claim 1, further comprising at least one element selected from the group consisting of:

carbon (C) in an amount of 0.05–1.0% by weight;

nitrogen (N) in an amount of 0.05–0.8% by weight; and boron (B) in an amount of 0.01 to 1.0% by weight, when the entirety is taken as 100% by weight.

17. The titanium alloy set forth in claim 16 having a cold working structure of 10% or more, exhibiting an average Young's modulus of 70 GPa or less, and exhibiting a tensile elastic limit strength of 750 MPa or more.

18. The titanium alloy set forth in claim 1, further comprising at least one element selected from the group consisting of:

carbon (C) in an amount of 0.05–1.0% by weight; and nitrogen (N) in an amount of 0.05–0.8% by weight; when the entirety is taken as 100% by weight.

19. The titanium alloy set forth in claim 18 having said cold working structure of 50% or more, exhibiting the average Young's modulus of 65 GPa or less, and exhibiting the tensile elastic limit strength of 800 MPa or more.

20. The titanium alloy set forth in claim 19 having said cold working structure of 70% or more, exhibiting the average Young's modulus of 60 GPa or less, and exhibiting the tensile elastic limit strength of 850 MPa or more.

21. The titanium alloy set forth in claim 20 having said cold working structure of 90% or more, exhibiting the average Young's modulus of 55 GPa or less, and exhibiting the tensile elastic limit strength of 900 MPa or more.

22. The titanium alloy set forth in claim 1 having a cold working structure of 10% or more, exhibiting an average Young's modulus of 70 GPa or less, and exhibiting a tensile elastic limit strength of 750 MPa or more.

23. The titanium alloy set forth in claim 22 having said cold working structure of 50% or more, exhibiting the average Young's modulus of 65 GPa or less, and exhibiting the tensile elastic limit strength of 800 MPa or more.

24. The titanium alloy set forth in claim 23 having said cold working structure of 70% or more, exhibiting the average Young's modulus of 60 GPa or less, and exhibiting the tensile elastic limit strength of 850 MPa or more.

25. The titanium alloy set forth in claim 24 having said cold working structure of 90% or more, exhibiting the average Young's modulus of 55 GPa or less, and exhibiting the tensile elastic limit strength of 900 MPa or more.

26. A process for producing the titanium alloy of claim 1 characterized in that said process comprises the steps of:

a mixing step of mixing at least two or more raw material powders containing titanium and an element of group Va in an amount of 30–60% by weight;

a compacting step of compacting a mixture powder obtained by the mixing step to a green compact of a predetermined shape; and a sintering step of sintering the green compact obtained in the compacting step by heating.

27. The process for producing a titanium alloy set forth in claim 26, wherein said raw material powders contain one or more elements selected from the metallic element group consisting of zirconium (Zr), hafnium (Hf) and scandium (Sc) in a summed amount of 20% by weight or less when the entirety is taken as 100% by weight.

28. The process for producing a titanium alloy set forth in claim 26, wherein said raw material powder comprises two or more of a pure metallic powder and/or an alloy powder.

29. The process for producing a titanium alloy set forth in claim 26, wherein said raw material powder comprises an alloy powder containing titanium and at least a Va group element.

30. The process for producing a titanium alloy set forth in claim 26, further having:

a hot working step of hot working a sintered body obtained after said sintering step, thereby densifying a structure of the sintered body;

a cold working step of cold working a sintered body obtained after said sintering step to a workpiece or a product; or a combination thereof.

31. The process for producing a titanium alloy set forth in claim 26, wherein said raw material powder further contains at least one or more elements selected from the group consisting of chromium, manganese, cobalt, nickel, molybdenum, iron, tin, aluminum, oxygen, carbon, nitrogen and boron.

32. The process for producing a titanium alloy set forth in claim 31, further having:

a hot working step of hot working a sintered body obtained after said sintering step, thereby densifying a structure of the sintered body;

a cold working step of cold working a sintered body obtained after said sintering step to a workpiece or a product; or a combination thereof.

33. A titanium alloy characterized in that said titanium alloy comprises one or more elements selected from the metallic element group consisting of zirconium (Zr), hafnium (Hf) and scandium (Sc) in a summed amount of 20% by weight or less, an element of Va group (the vanadium group) in a summed amount of 30–60% by weight together with the one or more elements of the metallic element group and the balance of titanium substantially, exhibits an average Young's modulus of 75 GPa or less, exhibits a tensile elastic limit strength of 700 MPa or more, and the gradient of the tangential line in a stress-strain diagram obtained by a tensile test within an elastic deformation range, in which the stress ranges from 0 to the tensile elastic limit strength, decreases continuously with increase in stress.

34. The titanium alloy set forth in claim 33 further comprising:

one or more elements selected from the metallic element group consisting of chromium (Cr), molybdenum (Mo), manganese (Mn), iron (Fe), cobalt (Co) and nickel (Ni), wherein said chromium and said molybdenum constitute 20% by weight or less, respectively, and said manganese, said iron, said cobalt and said nickel constitute 10% by weight or less, respectively, aluminum (Al) in an amount of 0.3–5% by weight; or a combination thereof, when the entirety is taken as 100% by weight.

35. A process for producing the titanium alloy of claim 33 characterized in that said process comprises the steps of:

a mixing step of mixing at least two or more raw material powders containing one or more elements selected from the metallic element group consisting of zirconium (Zr), hafnium (Hf) and scandium (Sc) in a summed amount of 20% by weight or less and an element of Va group (the vanadium group) in a summed amount of 30–60% by weight together with the one or more elements of the metallic element group;

a compacting step of compacting a mixture powder obtained by the mixing step to a green compact of a predetermined shape; and a sintering step of sintering the green compact obtained in the compacting step by heating.

36. A titanium alloy characterized in that said titanium alloy is a sintered alloy comprising an element of Va group (the vanadium group) in an amount of 30–60% by weight and the balance of titanium substantially, exhibits an average Young's modulus of 75 GPa or less, exhibits a tensile elastic limit strength of 700 MPa or more, and the gradient of the tangential line in a stress-strain diagram obtained by a tensile test within an elastic deformation range, in which the stress ranges from 0 to the tensile elastic limit strength, decreases continuously with increase in stress.

37. The titanium alloy set forth in claim 36 further comprising:

one or more elements selected from the metallic element group consisting of chromium (Cr), molybdenum (Mo), manganese (Mn), iron (Fe), cobalt (Co), nickel (Ni) and tin (Sn), wherein said chromium and said molybdenum constitute 20% by weight or less, respectively, and said manganese, said iron, said cobalt, said nickel and said tin constitute 10% by weight or less, respectively, aluminum (Al) in an amount of 0.3–5% by weight; or a combination thereof, when the entirety is taken as 100% by weight.

38. The titanium alloy set forth in claim 36, wherein one or more elements selected from the metallic element group consisting of zirconium (Zr), hafnium (Hf) and scandium (Sc) are contained in a summed amount of 20% by weight or less when the entirety is taken as 100% by weight.

39. The titanium alloy set forth in claim 38 further comprising:

one or more elements selected from the metallic element group consisting of chromium (Cr), molybdenum (Mo), manganese (Mn), iron (Fe), cobalt (Co), nickel (Ni) and tin (Sn), wherein said chromium and said molybdenum constitute 20% by weight or less, respectively, and said manganese, said iron, said cobalt, said nickel and said tin constitute 10% by weight or less, respectively, aluminum (Al) in an amount of 0.3–5% by weight; or a combination thereof, when the entirety is taken as 100% by weight.

40. The titanium alloy set forth in claim 36 containing oxygen (O) in an amount of 0.08–0.6% by weight when the entirety is taken as 100% by weight.

41. The titanium alloy set forth in claim 40, further comprising at least one element selected from the group consisting of:

carbon (C) in an amount of 0.05–1.0% by weight;

nitrogen (N) in an amount of 0.05–0.8% by weight; and boron (B) in an amount of 0.01 to 1.0% by weight, when the entirety is taken as 100% by weight.

42. The titanium alloy set forth in claim 41 exhibiting an average Young's modulus of 75 GPa or less, and exhibiting a tensile elastic limit strength of 700 MPa or more.

43. The titanium alloy set forth in claim 42, wherein said sintered alloy contains pores in an amount of 30% by volume or less.

44. The titanium alloy set forth in claim 43, wherein said sintered alloy has a structure in which the pores are densified to an amount of 5% by volume or less by hot working.

45. The titanium alloy set forth in claim 42 having said cold working structure of 50% or more, exhibiting the average Young's modulus of 65 GPa or less, and exhibiting the tensile elastic limit strength of 800 MPa or more.

46. The titanium alloy set forth in claim 45 having said cold working structure of 70% or more, exhibiting the average Young's modulus of 60 GPa or less, and exhibiting the tensile elastic limit strength of 850 MPa or more.

47. The titanium alloy set forth in claim 46 having said cold working structure of 90% or more, exhibiting the average Young's modulus of 55 GPa or less, and exhibiting the tensile elastic limit strength of 900 MPa or more.

48. The titanium alloy set forth in claim 41, wherein said sintered alloy contains pores in an amount of 30% by volume or less.

49. The titanium alloy set forth in claim 48, wherein said sintered alloy has a structure in which the pores are densified to an amount of 5% by volume or less by hot working.

50. The titanium alloy set forth in claim 41, wherein said sintered alloy has a structure in which the pores are densified to an amount of 5% by volume or less by hot working.

51. The titanium alloy set forth in claim 40, further comprising at least one element selected from the group consisting of:

carbon (C) in an amount of 0.05–1.0% by weight; and nitrogen (N) in an amount of 0.05–0.8% by weight;

when the entirety is taken as 100% by weight.

52. The titanium alloy set forth in claim 51 exhibiting an average Young's modulus of 75 GPa or less, and exhibiting a tensile elastic limit strength of 700 MPa or more.

53. The titanium alloy set forth in claim 51, wherein said sintered alloy has a structure in which the pores are densified to an amount of 5% by volume or less by hot working.

54. The titanium alloy set forth in claim 51 having a cold working structure of 10% or more, exhibiting an average Young's modulus of 70 GPa or less, and exhibiting a tensile elastic limit strength of 750 MPa or more.

55. The titanium alloy set forth in claim 54 having said cold working structure of 50% or more, exhibiting the average Young's modulus of 65 GPa or less, and exhibiting the tensile elastic limit strength of 800 MPa or more.

56. The titanium alloy set forth in claim 55 having said cold working structure of 70% or more, exhibiting the average Young's modulus of 60 GPa or less, and exhibiting the tensile elastic limit strength of 850 MPa or more.

57. The titanium alloy set forth in claim 56 having said cold working structure of 90% or more, exhibiting the average Young's modulus of 55 GPa or less, and exhibiting the tensile elastic limit strength of 900 MPa or more.

58. The titanium alloy set forth in claim 40 exhibiting an average Young's modulus of 75 GPa or less, and exhibiting a tensile elastic limit strength of 700 MPa or more.

59. The titanium alloy set forth in claim 58, wherein said sintered alloy contains pores in an amount of 30% by volume or less.

60. The titanium alloy set forth in claim 59, wherein said sintered alloy has a structure in which the pores are densified to an amount of 5% by volume or less by hot working.

61. The titanium alloy set forth in claim 58, wherein said sintered alloy has a structure in which the pores are densified to an amount of 5% by volume or less by hot working.

62. The titanium alloy set forth in claim 58 having a cold working structure of 10% or more, exhibiting an average Young's modulus of 70 GPa or less, and exhibiting a tensile elastic limit strength of 750 MPa or more.

63. The titanium alloy set forth in claim 40, wherein said sintered alloy contains pores in an amount of 30% by volume or less.

64. The titanium alloy set forth in claim 63, wherein said sintered alloy has a structure in which the pores are densified to an amount of 5% by volume or less by hot working.

65. The titanium alloy set forth in claim 40, wherein said sintered alloy has a structure in which the pores are densified to an amount of 5% by volume or less by hot working.

66. The titanium alloy set forth in claim 36, further comprising at least one element selected from the group consisting of:

carbon (C) in an amount of 0.05–1.0% by weight;

nitrogen (N) in an amount of 0.05–0.8% by weight; and boron (B) in an amount of 0.01 to 1.0% by weight, when the entirety is taken as 100% by weight.

67. The titanium alloy set forth in claim 66 exhibiting an average Young's modulus of 75 GPa or less, and exhibiting a tensile elastic limit strength of 700 MPa or more.

68. The titanium alloy set forth in claim 67, wherein said sintered alloy contains pores in an amount of 30% by volume or less.

69. The titanium alloy set forth in claim 68, wherein said sintered alloy has a structure in which the pores are densified to an amount of 5% by volume or less by hot working.

70. The titanium alloy set forth in claim 67 having said cold working structure of 50% or more, exhibiting the average Young's modulus of 65 GPa or less, and exhibiting the tensile elastic limit strength of 800 MPa or more.

71. The titanium alloy set forth in claim 70 having said cold working structure of 70% or more, exhibiting the average Young's modulus of 60 GPa or less, and exhibiting the tensile elastic limit strength of 850 MPa or more.

72. The titanium alloy set forth in claim 71 having said cold working structure of 90% or more, exhibiting the average Young's modulus of 55 GPa or less, and exhibiting the tensile elastic limit strength of 900 MPa or more.

73. The titanium alloy set forth in claim 36, further comprising at least one element selected from the group consisting of:

carbon (C) in an amount of 0.05–1.0% by weight; and nitrogen (N) in an amount of 0.05–0.8% by weight;

when the entirety is taken as 100% by weight.

74. The titanium alloy set forth in claim 66, wherein said sintered alloy contains pores in an amount of 30% by volume or less.

75. The titanium alloy set forth in claim 74, wherein said sintered alloy has a structure in which the pores are densified to an amount of 5% by volume or less by hot working.

76. The titanium alloy set forth in claim 66, wherein said sintered alloy has a structure in which the pores are densified to an amount of 5% by volume or less by hot working.

77. The titanium alloy set forth in claim 73 exhibiting an average Young's modulus of 75 GPa or less, and exhibiting a tensile elastic limit strength of 700 MPa or more.

78. The titanium alloy set forth in claim 73, wherein said sintered alloy has a structure in which the pores are densified to an amount of 5% by volume or less by hot working.

79. The titanium alloy set forth in claim 73 having a cold working structure of 10% or more, exhibiting an average Young's modulus of 70 GPa or less, and exhibiting a tensile elastic limit strength of 750 MPa or more.

80. The titanium alloy set forth in claim 79 having said cold working structure of 50% or more, exhibiting the average Young's modulus of 65 GPa or less, and exhibiting the tensile elastic limit strength of 800 MPa or more.

81. The titanium alloy set forth in claim 80 having said cold working structure of 70% or more, exhibiting the average Young's modulus of 60 GPa or less, and exhibiting the tensile elastic limit strength of 850 MPa or more.

82. The titanium alloy set forth in claim 81 having said cold working structure of 90% or more, exhibiting the average Young's modulus of 55 GPa or less, and exhibiting the tensile elastic limit strength of 900 MPa or more.

83. The titanium alloy set forth in claim 36 exhibiting an average Young's modulus of 75 GPa or less, and exhibiting a tensile elastic limit strength of 700 MPa or more.

84. The titanium alloy set forth in claim 83, wherein said sintered alloy contains pores in an amount of 30% by volume or less.

85. The titanium alloy set forth in claim 84, wherein said sintered alloy has a structure in which the pores are densified to an amount of 5% by volume or less by hot working.

86. The titanium alloy set forth in claim 83, wherein said sintered alloy has a structure in which the pores are densified to an amount of 5% by volume or less by hot working.

87. The titanium alloy set forth in claim 83 having a cold working structure of 10% or more, exhibiting an average Young's modulus of 70 GPa or less, and exhibiting a tensile elastic limit strength of 750 MPa or more.

88. The titanium alloy set forth in claim 36, wherein said sintered alloy contains pores in an amount of 30% by volume or less.

89. The titanium alloy set forth in claim 88, wherein said sintered alloy has a structure in which the pores are densified to an amount of 5% by volume or less by hot working.

90. The titanium alloy set forth in claim 36, wherein said sintered alloy has a structure in which the pores are densified to an amount of 5% by volume or less by hot working.

91. A process for producing the titanium alloy of claim 36 characterized in that said process comprises the steps of:

a packing step of packing a raw material powder containing titanium and at least an element of group Va in an amount of 30–60% by weight into a container of a predetermined shape; and a sintering step of sintering the raw material powder in the container by using a hot isostatic pressing method (HIP method) after the packing step.

92. The process for producing a titanium alloy set forth in claim 91, wherein said raw material powder contains one or more elements selected from the metallic element group consisting of zirconium (Zr), hafnium (Hf) and scandium (Sc) in a summed amount of 20% by weight or less when the entirety is taken as 100% by weight.

93. A titanium alloy characterized in that said titanium alloy is a sintered alloy comprising one or more elements selected from the metallic element group consisting of zirconium (Zr), hafnium (Hf) and scandium (Sc) in a summed amount of 20% by weight or less, an element of Va group (the vanadium group) in a summed amount of 30–60% by weight together with the one or more elements of the metallic element group, and the balance of titanium substantially, exhibits an average Young's modulus of 75 GPa or less, exhibits a tensile elastic limit strength of 700 MPa or more, and the gradient of the tangential line in a stress-strain diagram obtained by a tensile test within an elastic deformation range, in which the stress ranges from 0 to the tensile elastic limit strength, decreases continuously with increase in stress.

94. The titanium alloy set forth in claim 93 further comprising:

one or more elements selected from the metallic element group consisting of chromium (Cr), molybdenum (Mo), manganese (Mn), iron (Fe), cobalt (Co), nickel (Ni) and tin (Sn), wherein said chromium and said molybdenum constitute 20% by weight or less, respectively, and said manganese, said iron, said cobalt, said nickel and said tin constitute 10% by weight or less, respectively, aluminum (Al) in an amount of 0.3–5% by weight; or a combination thereof, when the entirety is taken as 100% by weight.

95. A process for producing the titanium alloy of claim 93 characterized in that said process comprises the steps of:

a packing step of packing a raw material powder containing at least titanium, one or more elements selected from the metallic element group consisting of zirconium (Zr), hafnium (Hf) and scandium (Sc) in a summed amount of 20% by weight or less and an element of Va group (the vanadium group) in a summed amount of 30–60% by weight together with the one or more elements of the metallic element group into a container of a predetermined shape; and a sintering step of sintering the raw material powder in the container by using a hot isostatic pressing method (HIP method) after the packing step.

* * * * *

UNITED STATES PATENT AND TRADEMARK OFFICE

CERTIFICATE OF CORRECTION

PATENT NO. : 6,607,693 B1
DATED : August 19, 2003
INVENTOR(S) : Takashi Saito et al.

It is certified that error appears in the above-identified patent and that said Letters Patent is hereby corrected as shown below:

Column 38,
Line 16, "and'said" should read -- and said --.

Signed and Sealed this

Twenty-fourth Day of February, 2004

JON W. DUDAS
*Acting Director of the United States Patent and Trademark Office*